United States Patent [19]

Tsukamura

[11] Patent Number: 4,705,184

[45] Date of Patent: Nov. 10, 1987

[54] METAL CONTAINERS WITH SEAM HOLDING END CLOSURE THEREON

[75] Inventor: Takao Tsukamura, Funabashi, Japan

[73] Assignee: Nittetsu Steel Drum Co., Ltd., Tokyo, Japan

[21] Appl. No.: 766,068

[22] Filed: Aug. 14, 1985

Related U.S. Application Data

[60] Continuation of Ser. No. 620,793, Jun. 14, 1984, abandoned, which is a division of Ser. No. 469,572, Feb. 24, 1983, Pat. No. 4,543,025.

[30] Foreign Application Priority Data

Feb. 26, 1982 [JP] Japan ..... 57-29044
Aug. 9, 1982 [JP] Japan ..... 57-137363

[51] Int. Cl.[4] ..... B65D 8/08; B65D 8/20

[52] U.S. Cl. ..... 220/67; 220/74; 220/78; 220/79; 220/81 R

[58] Field of Search ..... 220/74, 78, 79, 67, 220/81 R

[56] References Cited

U.S. PATENT DOCUMENTS

| | | | |
|---|---|---|---|
| 294,167 | 2/1884 | Walsh | 220/79 |
| 475,656 | 5/1892 | Bertels | 220/79 |
| 1,389,900 | 9/1921 | Robinson . | |
| 2,169,395 | 8/1939 | Rheem . | |
| 2,197,439 | 4/1940 | Sebell . | |
| 2,337,452 | 12/1943 | Compo . | |
| 2,460,296 | 2/1949 | Kinney . | |
| 2,573,524 | 10/1951 | Weisberg et al. | 220/79 X |
| 3,160,312 | 12/1964 | Johnston . | |
| 3,425,381 | 2/1969 | Wessely . | |
| 3,736,893 | 6/1973 | Coppens et al. | 220/67 X |
| 3,921,848 | 11/1975 | Dolveck | 220/67 |
| 3,987,927 | 10/1976 | Serr et al. | 220/74 X |

FOREIGN PATENT DOCUMENTS

| | | | |
|---|---|---|---|
| 217070 | 7/1907 | Fed. Rep. of Germany . | |
| 2038540 | 2/1971 | Fed. Rep. of Germany | 220/78 |
| 54-6958 | 4/1979 | Japan . | |
| 506182 | 5/1939 | United Kingdom . | |
| 1337169 | 11/1973 | United Kingdom | 220/79 |

OTHER PUBLICATIONS

W. R. Grace & Co., Dewey and Almy Technical Bulletin, Jan. 15, 1954, "Evaluating a Double Seam".

Can Containers and Double Seam, The Can Society of Japan, 1965.

*Primary Examiner*—Allan N. Shoap

*Attorney, Agent, or Firm*—Wenderoth, Lind & Ponack

[57] ABSTRACT

A metal container has a seam which comprises two continuous groups of concentric circular arcs having a center angle of 180 degrees or 180 degrees and under 180 degrees and centered on two points separated from each other by a distance equal to ½ of the sum of the thickness of two metal sheets making up the seam. The axis of the seam is a straight line passing through the two centers that can be inclined at any angle with respect to the axis of the container. The seam has a cross-sectional shape that is mostly point-symmetrical with respect to a center that is the mid-point between the two centers. The seam is formed by an apparatus which comprises a seaming roll and a chuck ring, each of which has a forming groove comprising, in cross-section, two continuous circular arcs centered on two points that are separated from each other by the distance equal to ½ of the sum of the thickness of the metal sheets making up the seam. The seaming roll and chuck ring are disposed in such a manner that at least one of the center-to-center distances between one of the centers of curvature in the forming groove of the seaming roll and one of the centers of curvature in the forming groove of the chuck ring becomes equal to ½ of the sum of the thicknesses of the metal sheets making up the seam upon completion of seaming. The flanges of the body and end closure sheets are seamed together into two continuous groups of concentric circular arcs, without relative displacement in their extreme edges, after placing the extreme edges of both flanges into such relative positions as are occupied at the center of the completed seam.

7 Claims, 37 Drawing Figures

METAL CONTAINERS WITH SEAM HOLDING END CLOSURE THEREON

CROSS-REFERENCE TO RELATED APPLICATION

This application is a continuation of now abandoned application Ser. No. 620,793, filed June 14, 1984, now abandoned, which is a division of Ser. No. 469,572, filed Feb. 24, 1983, now U.S. Pat. No. 4,543,025, issued Sept. 24, 1985.

BACKGROUND OF THE INVENTION

1. Field of the Invention

This invention relates to metal containers and their manufacturing methods and apparatuses.

2. Description of the Prior Art

A steel drum, for example, is made by joining the flanges formed at the edge of a cylindrical body sheet and an end sheet (top and/or bottom). After properly laying and temporarily fitting one flange over the other, the flanges of the body and end sheet are multifolded to form a seam. The conventional seams of metal containers come in such cross-sectional shapes as elliptical, egg-shaped, round-cornered rectangular, spiral, and their variations. At the center of an elliptical, egg-shaped, rectangular and other similar elongated seam, the extreme edges of the body and end plate flanges are hooked flat to each other. The inner portions of the flanges are tightly multifolded, one flange parallel to the other. In a spiral seam, on the other hand, each individual fold has a gradually varying radius. Because of the flat hooking at the center, the elongated seam like the elliptical one requires larger body and end plates than the spiral one, which results in higher production cost. In addition to this economic disadvantage, the seam of this type does not have uniform strength in all directions. Meanwhile, a spiral seam having folds of gradually varying radii is usually made up of two metal sheets. Since the forming groove on a seamling roll cannot have an opening wider than 180 degrees, the metal sheets leaving the forming groove are curved in conformity with the radius of curvature at the exit end of the roll. This results in an undesirable mixture of spiral and circular bends in the seam, or, otherwise, an undesirable gap near the seam center which, in turn, leads to a larger seam and, therefore, calls for the use of larger body and end sheets. A typical example of the conventional seaming methods is the one proposed by Wessely (which is also known as the Gallay's method), U.S. Pat. No. 3,425,381 - Re. 29,307, which comprises the following three steps that are carried out in succession:

(1) To curl, using a roll, the edge of the flange of an end sheet (top or bottom) until the same comes into substantially immediate facing relation with the flange of a body sheet (ref., Johnston, U.S. Pat. No. 3,160,312, and Compo, U.S. Pat. No. 2,337,452);

(2) To impart a relative displacement to the flanges of both end and body sheets (the known multifolding bending principle traditionally utilized in the formation of a five-fold seam); and (3) To roll the flange edge of the body sheet through substantially 270 degrees, thereby interengaging the flange edges of both sheets to form a seven-fold seam (ref., Rheem, U.S. Pat. No. 2,169,395, and Defauw, United Kingdom Pat. No. 506,182).

According to this method combining the known fabrication steps, a seven-fold seam can be obtained by a continuous bending forming operation on a roll, without requiring the ultimate flattening of the seam. The disadvantage of this method is as follows: The end sheet flange is curved along the forming groove on a seaming roll to form the outline of a seam. Toward the end of the seaming operation, the flange edges of both sheets strike against the inner portions thereof to get deformed. It is when seaming is completed that the flange edges are interlocked to form the center of the seam. For this reason, the deformation of the flange edges forming the seam center does not take place in a stable fashion. The interlock and contact between the two flanges are neither stable nor uniform, leaving an undesirable gap in the seam.

Another known seaming method is that which was proposed by Coppens and Steen (known also as the Van Leer's method). This method disclosed in Netherlands Pat. Nos. 6,911,769 and 7,009,657, U.S. Pat. No. 3,736,893 and Japanese Patent No. 989,815 comprises the following three steps:

(1)′ To bend the edge of the end flange about 180 degrees into a U-shaped bend with a first seaming roller having in cross-section a semi-circular groove of very small radius, and apply a sealing compound in the U-shaped bend (ref., W. R. Grace & Co., Dewey and Almy Technical Bulletin, Jan. 15, 1954 and Can Containers and Double Seam, The Can Society of Japan, 1965);

(2)′ To form the body flange in which a widewall of said body merges into the end flange with a radius which is considerably larger than the radius of curvature at the junction of the end flange and an adjacent cylindrical portion of said end (ref., Kinney, U.S. Pat. No. 2,460,296, Johnston, U.S. Pat. No. 3,160,312 and Krummel, German Patent No. 217,070); and (3)′ To roll the flanges closely into each other with a seaming roller having, when viewed in cross-section, a semi-circular groove bottom in which the end flange is bent over more than 360 degrees and the body flange is bent over more than 270 degrees to form a seam connection having a closed spiral shaped cross-section.

This method provides a seam that has the following characteristics:

(4)′ The seam wherein the flanges are in a spiral shaped winding of gradually changing radii and are in metal-to-metal contact throughout the entire cross-section of said seam connection (ref., Robinson, U.S. Pat. No. 1,389,900 and Krummel, German Patent No. 217,070);

(5)′ The sealing compound resides exclusively in the center of the seam (ref. Krummel, German Patent No. 217,070, and Sebell, U.S. Pat. No. 2,197,439); and (6)′ The center of the seam is completely filled with the sealing compound under pressure. (The sealing compound is naturally kept under pressure since seaming is effected after the sealing compound has been filled and dried according to step (1)′ described previously.)

This seaming method and the seam made by it has some shortcomings. Namely, the end enclosure flange forms the outline of a seam running along the semicircular groove on the seaming roll. Toward the end of the seaming operation, the hollow edge (U- or channel-shaped) of the end closure flange strikes against the body plate and gets deformed. The bending moment to cause this deformation is great in the curved portion of the U-shaped edge and the adjacent portion of the flange. The bending moment is also restrained by the semi-circularly shaped edge of the body flange. Therefore, the bend radius of the hollow edge increases, as a consequence of which the seaming operation completes without bending the straight portion of the hollow edge. Because of this, the pre-filled sealing compound must be elastic and plentiful enough to allow the hollow edge to undergo a deformation of any fashion and any magnitude. Besides, the unbent portion of the hollow edge does not stick fast to the opposite body flange, creating an undesirable gap in the seam.

Features of the spiral shaped seam and the method for making the same in this U.S. Pat. No. 3,736,893 are characterized in such manners that the seam has very much sealing compounds and the body flange edge is cored in the bent hollow edge of the end closure namely in the sealing compound present in it but cannot, however, shift with respect to the bent hollow edge during the seaming operation.

FIGS. 1-*a* through 1-*c* and FIGS. 2-*a* through 2-*c* are cross-sectional views respectively illustrating a five-fold seam and a seven-fold seam made by the method just described in three stages; i.e., (a) temporary interlocking (to start seaming), (b) a later stage of seaming, and (c) completion of seaming. Reference character 1 designates an end closure flange, 2 a body flange, R the semi-circular groove on a seaming roll, and 1' and 2' end and body plates proper contiguous to the end closure and body flanges, with a chain line indicating the center axis of the semi-circular groove.

FIG. 1-*a* and 2-*a* show the temporary interlocking stage with which a seaming operation begins. The end closure and body flanges are bent and folded together by the semi-circular groove R of the descending seaming roll.

FIG. 1-*b* shows a state in which the extreme edge of the body flange 2 has been bent by 180 degrees in a five-fold seam. FIG. 2-*b* shows a state in which the U-shaped edge of the end closure flange 1 in a seven-fold seam comes in contact with the body flange 2. In both figures, the extreme edge of the body flange 2 is cored in the U-shaped edge of the end closure flange 1. Coring begins with a given winding angle which depends, assuming that both flanges have the same thickness, upon the length of the protruding straight portion of the U-shaped edge, the relative positions of both flange edges in the temporarily interlocked condition, and the radius of curvature of the semi-circular groove R on the seaming roll, and ends with another given winding angle.

The bending-forming by the semi-circular groove on the seaming roll reduces the bend angle of the U-shaped edge to below 180 degrees. When the edge of the end closure flange 1 touches the body flange, the bend angle temporarily increases. Since the width of the U-shaped hollow edge is larger than the flange thickness, however, the bend angle of the U-shaped edge soon becomes smaller than 180 degrees. A comparison among FIGS. 1-*a*, 1-*b* and 1-*c* and among FIGS. 2-*a*, 2-*b* and 2-*c* clearly shows that the relative positions of both flange edges move as the seaming operation proceeds.

FIG. 1-*b* shows a state in which the extreme edge of the body flange 2 has been bent by 180 degrees. The seaming operation of a five-fold seam must have been completed in this state. As shown, however, the external side of the U-shaped edge of the end closure flange 1 is not in contact with the body flange 2, with the sealing compound not residing at the center of the formed seam. To avoid this, the U-shaped edge must have been deformed, striking against the body sheet proper 2', before the seaming operation reaches the state of FIG. 1-*b*. It is therefore indispensable to this method that the U-shaped edge of the end closure flange 1 gets deformed striking against the body sheet proper 2'. The force causing this deformation acts on a point at which the U-shaped edge touches the body sheet proper 2'. A maximum bending moment works on that point of the end closure flange 1 which rests at the exit end of the semi-circular groove R on the seaming roll. Therefore, the end closure flange 1 contiguous to the U-shaped edge undergoes the sharpest bend at the exit end of the semicircular groove R. A deforming force arises when the extreme edge of the end closure flange 1 is restrained by the semi-circularly bent body flange. Then, a maximum bending moment arises where the U-shaped edge touches the body sheet proper 2', whereupon the bend angle increases to open the U-shaped edge. As a result of all this, the seam shown in FIG. 1-*c* is formed. As illustrated, the upper half of the seam is circular, while the lower half is composed of a curve and a straight line. Particularly the end closure flange 1 forms two curves with gradually varying radii and two straight lines at the center of the seam. One of the straight lines remains unbent because the bending moment to open the U-shaped edge is smaller in the straight portion of the U-shaped edge than at the point where the U-shaped edge touches the body sheet proper 2'. This leaves a gap between the edge of the end closure flange and the opposite body flange, making it theoretically very difficult to bring both flanges into close contact with each other.

FIG. 2-*b* shows a state in which the U-shaped edge of the end closure flange 1 touches the body flange 2 in a seven-fold seam. Assuming that the under side of the end closure flange 1 gets deformed striking against the body sheet proper 2' before reaching the state shown in FIG. 2-*b*, the force acting on the point of contact exercises a maximum bending moment on both flanges 1 and 2 at the exit end of the semi-circular groove R on the seaming roll, thereby causing both flanges 1 and 2 to undergo the sharpest bend at the same exit end. Meanwhile, the force working on the point where the U-shaped edge of the end closure lange 1 touches the body flange 2 exercises a bending moment opposite to said bending moment on that point of both flanges 1 and 2 which rests at the exit end of the semi-circular groove R and a maximum bending moment at a point where the lower side of the end closure flange 1 touches the body sheet proper 2', thereby bending the end closure flange 1 in the seaming direction. This deformation temporarily reduces the opening of the U-shaped edge. Since the extreme edge of the end closure flange 1 is restrained by the internal side of the semi-circularly shaped body flange 2, however, the U-shaped edge opens again, whereupon the straight portion thereof is bent to form a seam shown in FIG. 2-*c*. The seam schematically sketched in FIG. 2-*c* has a more complex form in reality. While the upper half is circular, the lower half is composed of curves and straight lines. Especially, the end closure flange 1 consists of two curves with gradually varying radii at the center of the seam and two straight lines. The extreme edge of the end closure flange 1 is out of contact with the body flange 2, leaving a gap therebetween. The difference between the winding angles of both flange edges exceeds 180 degrees. If the straight portion of the U-shaped edge were shortened so that the winding angle difference should be kept within 180 degrees, the edge of the end closure flange would be restrained to a lesser extent by the internal side of the body flange, whereby the U-shaped edge would be deformed less to make said gap larger. If the under side of the end closure flange 1 did not touch the body plate proper 2' and get deformed in FIG. 2-*b*, the whole body flange 2 would be bent circularly, with the U-shaped edge of the end closure flange 1 only getting deformed upon contact with the body flange 2. Accordingly, the end closure flange 1 at the seam center would be formed like the case shown in FIG. 2-*c* to leave a still greater gap. This defect in the seam is due to the seaming method which forms a U-shaped edge before seaming, varies the radius of curvature of the U-shaped edge at the center of the seam in the later stage of the seaming operation, and, thereby, turns the straight protruding portion of the U-shaped edge. Besides, a large quanty of sealing compound elastic enough to withstand any deformation during seaming must be laid from within the U-shaped edge to the extreme edge of the end sheet in order that the center of the seam is completely filled with the sealing compound upon completion of seaming. Meanwhile, the center of the seam must be large enough to allow the straight protruding portion of the U-shaped edge to turn as the radius of curvature thereof varies. This spells a large seam diameter and, therefore, the requirement for larger body and metal plates. The extreme edge of the end closure flange, either straight or curved in shape, remains out of contact with the opposite body flange. Because of the need to form the U-shaped edge and fill and allow to dry a sealing compound therein before seaming, this method involves more processes, more equipment and higher production cost than the aforementioned method according to U.S. Pat. No. - Re. 29,307. Circularly formed with a large radius of curvature, the body flange is apt to get loose and disengaged from the temporarily interlocked end sheet. With the U-shaped edge deforming unstably and that side of the seam which does not contact the semicircular groove forming unstable curves and straight lines during seaming, it is difficult to theoretically exactly set the length of both body and end closure flanges. It is therefore difficult to ensure the uniformity of seam form, especially that of the seam center structure. It is also difficult to attain a close contact between both flanges at the center of the seam, with the straight portion of the U-shaped edge remaining unbent or getting deformed into form a curved line.

The unstable deformation of the seam-forming metal sheets during the seaming operation and the unstable form of the seam itself are the defects common to the conventional seams and their forming methods. It has therefore been impracticable to theoretically exactly calculate and determine the length as well as the straight and curved portions of both flanges for temporary interlocking.

SUMMARY OF THE INVENTION

An object of this invention is to provide metal containers having high strength, uniform structure and quality, or, more specifically, having a stably and uniformly formed seam center, dispensing with an undesirable gap impairing the strength and leakproofness of the seam, and requiring less sealing compound than ever, through the improvement of the defects inherent in the conventional seams of metal containers and their manufacturing methods and equipment.

Another object of this invention is to provide methods and apparatuses that can economically manufacture such seamed metal containers as described above.

A technical conception of this invention is to form a seam similar to an ideal seam having a totally circular outline, which is physically impossible to form with two metal sheets that are folded together while being kept in close contact with each other, by forming two kinds of metal sheets into two continuous groups of concentric circular arcs about shifted centers, and also to save the consumption of metal sheets by reducing the radius of curvature of the seam center or omitting the circular portion thereof according to the strength required thereat within the limit that the metal plates remain unfractured.

Another technical conception of this invention is as follows: Conventional seaming methods form the outline of a seam along the forming groove on a seaming roll in the initial stage of seaming, wind the edge of body and end closure flanges forming the seam by striking them against the outer flange in the later stage, and then form the center of the seam that has the smallest radius of curvature in the seam when completing the seaming operation. Because of this seaming procedure, the structure of the seam center obtained is unstable and nonuniform, which, in turn, creates an undesirable gap between the two flanges making up the seam or between the extreme edge of the end closure flange and the opposite body flange at the center of the seam. The aforementioned shortcomings can be eliminated by the method for manufacturing a seam based on the technical concept of this invention, comprising progressively forming a plurality of metal sheets (sheets of the end and body flanges) into a plurality of circular arcs having a center angle of 180 degrees or a center angle of 180 degrees for one and under 180 degrees for the other, into continuous two kinds of groups of concentric circular arcs around two centers having a center distance of a half of sum of thicknesses of said metal sheets, into a shape of point symmetry having a center of symmetry which is the middle point between the two centers of said two groups of concentric circular arcs, when viewed in profile, and into a seam, using a seaming roll and a chuck ring each of which has a forming groove comprising two continuous circular arcs made by two centers having a center distance of $\frac{1}{2}$ of sum of thicknesses of said metal sheets, when viewed in profile. According to the abovementioned method based on the technical conception of this invention, a plurality of metal sheets to constitute a seam are very easily and smoothly formed since said sheets are formed along said forming groove comprising said two circular arcs having said center distance without the undesirable striking deformations resulting from the striking contact among the edge portions of the flanges and the body proper caused by the conventional method as mentioned above.

Still another technical conception of this invention is to form the center portion of a seam by forming the edge portion of the body flange along the end closure flange shaped into a plurality of continuous arcs at a point of the seaming process from starting to finishing and complete the seam by winding the suceeding flanges around said center portion, forming progressively the outer portion of the seam, thereby forming a stable and uniform seam about an exactly and tightly formed center portion, leaving no undesirable gap between both flanges and reducing the metal requirement. The gap in the seam not only impairs the seam quality but also leads to greater consumption of metal plates.

Yet another technical conception of this invention is as follows: To form the center portion of a seam during the seaming operation, it is necessary to form the edge portions of the body and end closure flanges into the circular arc portions with radii of curvature equal to those at the center portion of the desired seam. Since the edge portion of the end closure flange can be preformed to the desired radius of curvature using a known pre-curler, the problem to be solved during the seaming operation is how to form the edge of the body flange as desired. If the body flange edge forming is started with a winding angle of 90 degrees from the line at a point where seaming is started which is perpendicular to the axis of a container to be made, there is a likelihood, when the desired radius of curvature is very small, that the entirety of the body flange is pushed downward under the pressure of the seaming roll, with the intended forming not achieved. If, instead, the body flange edge forming with said radius of curvature is effected with a winding angle exceeding 90 degrees from the seaming starting point, the likelihood of the body flange descending decreases because the body flange edge receives the edge-bending force and another force working in the seaming direction. At the point where said forming is started, the pre-curled portion of the end closure flange is placed in a position where it prevents the body flange from being pushed down without interfering with the seaming operation. By placing the edges of both flanges in relative positions equal to those at the center of the seam to be formed, the center of the seam is formed at or ahead of the point where the body flange edge forming with the desired radius of curvature is started. To facilitate the forming of the seam center portion, the edge of the body flange can be pre-curled into a circular arc having a radius of curvature equal to the one that the body flange edge should have at the center of the desired seam.

A further technical conception of this invention is to form a desired seam when the body flange edge is formed with a relatively large radius of curvature at the center thereof, when the body flange edge is pre-curled, when the lengths of both body and end closure flanges are relatively short, or when said means to prevent the descent of the body flange is used, by forming the center portion of the desired seam in the earlier stage of the seaming operation and then tightly wrapping both flanges around the seam center portion thus formed. First, a seam smaller than the desired ultimate seam is formed at the edge portions of both flanges using a first seaming roll having a forming groove whose cross-sectional curve comprises a radius of curvature smaller than that of the desired seam. Second, the desired seam or the desired ultimate seam larger in wound layers than the seam made as a first step is formed using a second seaming roll and a chuck ring each having a forming groove whose cross-sectional curve is equal to that of the desired seam or has a larger radius of curvature than that of said first seaming roll.

A still further technical conception of this invention is to set the seaming roll and chuck ring, each having a forming groove, in a seamed metal container manufacturing apparatus in such a manner that the distance between at least one center of curvature of one of the two forming grooves and one center of curvature of the other forming groove becomes equal, on completion of seaming, to $\frac{1}{2}$ of the sum of the thicknesses of the two metal sheets or flanges making up the seam, and to provide such seaming roll and chuck ring as having a forming groove, the cross-sectional contour of which comprises two continuous circular arcs centered on two points that are separated from each other by the distance equal to $\frac{1}{2}$ of the sum of the thicknesses of the two metal sheets making up the seam.

Another technical conception of this invention is to provide a seaming roll having a forming groove whose cross-sectional curve is such that it begins forming with a radius of curvature that is equal to either the radius of curvature of the desired pre-curl or the minimum radius of curvature of the desired seam at a point of the seaming process where the winding angle of seaming becomes over 90 degrees from a straight line parallel to the direction in which said seaming roll works, at the point where the forming with said radius of curvature on the end closure flange begins with a winding angle of over 90 degrees, in order to omit the costly end closure flange pre-curling step, or in order that the seaming roll can also serve as a precurl roll, and also to provide a seaming roll, as a first seaming roll to form the center portion of the desired seam during the initial stage of the seaming operation, having a forming groove whose cross-sectional contour comprises a group of circular arcs at least one of which has a radius of curvature equal to the sum of the smallest radius of curvature on the inside of the body flange in the desired seam, the thickness of the body flange, and the thickness of the end closure flange.

Based on the technical conceptions just described, this invention has developed metal containers having seams of uniform quality that can provide the same strength as ever with a minimum quantity of metal, the structure thereof, and methods and apparatuses of manufacturing such metal containers.

What this invention discloses are as follows:

A seamed metal container in which a plurality of metal sheets making up a seam, each forming substantially two continuous groups of concentric circular arcs, are closely wrapped one over the other to form, in cross section, a plurality of concentric circular arcs, the seam being made up of a plurality of continuous sectors defined by said plurality of concentric circular arcs.

A seamed metal container whose seam is formed, in cross section, a plurality of metal sheets making up the seam into a plurality of circular arcs each having a center angle of 180 degrees or into a plurality of circular arcs each having a center angle of 180 degrees and those having a center angle of smaller than 180 degrees, and forming said arcs into two kinds of continuous groups of concentric circular arcs centered on two points separated from each other by a center distance equal to $\frac{1}{2}$ of the sum of the thicknesses of said metal sheets.

A seamed metal container whose seam is made up, in cross section, of said two continuous groups of concentric circular arcs comprising a shape of point symmetry having a center of symmetry which is the middle point between the two centers of said two concentric circular arc groups, except a portion of the outermost layer of the seam.

A seamed metal container whose seam is formed, when viewed in profile, into said two continuous groups of concentric circular arcs comprising a straight line which passes through the two centers of said two circular arc groups, has an angle of inclination being able to place at any angle ranging from 0 to 180 degrees to the axis of the container, comprising two portions which can be bisected by said straight line, each of which is formed into one of said two circular arc groups having one of said two centers respectively.

A seamed metal container in the seam of which the straight line passing through the two centers of said two concentric circular arc groups in cross section is either perpendicular or oblique or parallel to the axis of the metal container.

A seamed metal container in the seam of which the minimum radius of curvature of said two concentric circular arc groups in cross section is 0.5 to 1.0 times the thickness of the end sheet or the body sheet.

A seamed metal container in which a seam is made up of a plurality of concentric circular arcs formed by a plurality of metal sheets having, in cross section, two continuous groups of substantially concentric circular arcs and being tightly wrapped one over the other, with either or both of the circular arcs which each have the smallest radius of curvature in said two concentric circular arc groups and form the center of the seam having a center angle of between 0 and 180 degrees.

A method of manufacturing a metal container in which a seam is formed by bending the flanges of both end sheet and body sheet, in cross section, into a plurality of circular arcs each having a center angle of 180 degrees or those having a center angle of 180 degrees and that smaller than 180 degrees, forming said circular arcs into two continuous groups of concentric circular arcs centered on two points separated from each other by the center distance equal to $\frac{1}{2}$ of the sum of the thicknesses of the end sheet and body sheet, and forming said two groups of concentric circular arcs into a shape of point symmetry making the middle point between the two centers of two groups of concentric circular arcs as a center of symmetry, except a portion of the outermost layer of the seam.

A method of manufacturing a metal container in which a desired seam is formed by seaming the flanges, when viewed in profile, into said two continuous groups of concentric circular arcs in which an angle of inclination of a straight line passing through said two centers reaches a desired angle ranging from 0 to 180 degrees to the axis of the container, until the desired wound layers of the seam are reached.

A method of manufacturing a seamed metal container, in which a desired seam is made by temporarily interlocking the flanges of end and body sheets in an appropriate manner, placing the extreme edges of the end closure flange and body flange in such relative positions as should be occupied thereby when the desired seam has been completed at a certain desired transition point in the course of the seaming process, or at a certain desired angle of winding through which the edges of both flanges are wound from the beginning to completion of seaming, or at or before a certain transition point at which the edge of the body flange begins forming a radius of curvature equal to that at the center of the desired seam, or when the winding angle of the extreme edge of the body flange reaches a winding angle of over 90 degrees to a winding angle that is subtracted 0 to 180 degrees from the winding angle on completion of seaming, measuring from a straight line at the seaming starting point which is perpendicular to the axis of the container, and forming the center portion of the desired seam starting from said certain transition point, and in succession of finishing the forming of said center portion alternately winding the succeeding portion of said flanges around said center portion of the seam or winding said center portion on the inside of the succeeding portion of the body flange, and seaming together the wrapped layers tightly using a seaming roll that has a forming groove having the same shape as the contour of the desired seam and such radii of curvature as can form the smallest radius of curvature in the desired seam after forming the center portion of the desired seam.

A method of manufacturing a seamed metal container in which the flanges of an end sheet and body sheet, temporarily fitted together appropriately, are seamed using a seaming roll having such a radius of curvature as can form, during seaming, the edge portion of the body flange with a radius of curvature that is desired for the center portion of the seam being formed, the edge of the body flange begins forming with a radius of curvature equal to that of the body flange edge at the center portion of the seam when the winding angle of the extreme edge of the body flange reaches an angle that is over 90 degrees to an angle that is 0 to 180 degrees smaller than the ultimate winding angle, beyond the straight line at the starting point that is perpendicular to the axis of the container, and said forming of the edge of the body flange with said radius of curvature is started when said winding angle is reached by placing the extreme edges of both flanges into such relative positions as are desired in the completed seam.

A method of manufacturing a seamed metal container in which the desired seam is formed by forming the edge portion of a body flange into a bend with an angle of larger than 0 degree and smaller than 180 degrees, or a circular arc having a center angle of larger than 0 degree and smaller than 180 degrees, or a bend or a circular arc having a radius of curvature equal to the minimum radius of curvature of the body flange in the desired seam, or by forming the edge portion of a body flange into a circular arc having a center angle of larger than 0 degree and smaller than 180 degrees and the edge portion of an end closure flange into an arc having such an appropriate center angle of larger than 0 degree and smaller than 180 degrees as will not strike against the outside of said arc on the body flange during seaming, and then the body flange and end closure flange are seamed together after being temporarily fitted in an appropriate manner.

A method of manufacturing a seamed metal container in which a desired seam is formed by forming the edge portion of a body flange into an arc having a center angle of larger than 0 degree and smaller than 180 degrees, placing the extreme edges of both end closure flange and body flange into such relative positions as are desired in the completed seam when the winding angle of the extreme body flange edge reaches an angle that is over 90 degrees to an angle that is 0 to 180 degrees smaller than the ultimate winding angle beyond the straight line at the starting point that is perpendicular to the axis of the container, starting forming that portion of the body flange which follows the circular arc at the edge portion thereof (or which forms the center portion of the seam) into a radius of curvature equal to that at the center portion of the desired seam, winding the center portion of the seam thus formed on the inside of the following body flange or winding the following body and end closure flanges, alternately, around the formed seam center portion, and tightly seaming the flanges thus wound together.

A method of manufacturing a seamed metal container in which the center portion of a desired seam is formed in the earlier stage of the seaming operation using a seaming roll having a forming groove whose radius of curvature is smaller than that of the contour of the desired seam, the various desired seams are formed by winding the following portions of both end closure flange and body flange around the formed center portion into various desired layers using a seaming roll having a forming groove whose radius of curvature is larger than that of said first seaming roll, and the desired seam is formed by winding the following flanges around the formed center portion using a seaming roll having a forming groove whose cross-sectional curve is identical with the contour of the desired seam.

A method of manufacturing a metal container in which a seam having the wound layers smaller than that of the desired seam is formed on the edge portions of both end and body flanges, as a first stage, and then the desired seam is formed by winding the following portions of both end and body flanges around said smaller seam until the desired wound layers of the desired seam are reached as a second stage.

A method of manufacturing a seamed metal container in which a seam having the desired winding angle and layers is formed, after fitting an end closure flange, whose edge portion is bent or pre-bent over an angle of 0 to 180 degrees in cross section, to a body flange under a condition appropriate for the forming of the desired seam, by forming a circular arc having a center angle of 180 degrees at the edge portion of the end closure flange and forming the center portion of the desired seam in which the extreme edge of the body flange contacts just a straight line passing through the two points which are both starting-points of the internal curve of said circular arc and the outside of the body flange adheres closely to the inside of the end closure flange, using a first seaming roll, as a first stage, and then by closely winding the following portions of both flanges, alternately, around the seam center portion formed in the first stage until the winding angle of the extreme edges of the end and body flanges reaches the desired angle using a second seaming roll whose forming groove has a radius of curvature larger than that of the first seaming roll or whose forming groove has a radius of curvature larger than that of the first seaming roll and, at the same time, a cross-sectional curve identical to the contour of the desired seam as a second stage.

A method of manufacturing a seamed metal container in which a seam having the desired winding angle and desired layers is formed by fitting an end closure flange, whose edge portion is formed or pre-formed into an arc having a center angle of 180 degrees in cross section, to a body flange under a condition appropriate for the forming of the desired seam, seaming both flanges using a first seaming roll as a first stage, forming a first circular arc having a center angle of 180 degrees at the edge portion of the end closure flange, a second circular arc, next continuous to the first circular arc, having a radius of curvature that is larger than that of said first arc by the thickness of the body flange and a center angle of 0 to 180 degrees, and another arc, at the edge portion of the body flange, having an external radius of curvature equal to the internal radius of curvature of said second arc at the edge portion of the end closure flange and a center angle of 0 to 180 degrees on completion of said first seaming stage, bringing the extreme edge of the body flange into just contact with a straight line passing through the two points which are both starting-points of the internal curve of said first arc at the edge portion of the end closure flange and the external curve of the arc formed at the edge portion of the body flange into close contact with the internal curve of said second arc at the edge portion of the end closure flange, and then, as a second stage, by closely winding the following portions of both flanges, alternately, around the portion formed by said first seaming roll until the winding angle of the extreme edges of the end and body flanges reaches the desired angle using a second seaming roll whose forming groove has a radius of curvature larger than that of the first seaming roll or whose forming groove has a radius of curvature larger than that of the first seaming roll and, at the same time, a cross-sectional curve identical to the contour of the desired seam.

A method of manufacturing a seamed metal container in which a seam having the desired winding angle and the desired number of folds or layers is made by pre-forming an arc having a center angle of larger than 0 degree and smaller than 180 degrees at the edge portion of a body flange and an arc having an appropriate center angle of larger than 0 degree and smaller than 180 degrees, in such as manner that the arc should not strike against said first arc during seaming, at the edge portion of an end closure flange, fitting together both flanges appropriately, forming the center portion of the desired seam, as a first stage, using a first seaming roll and placing, on completion of the first-stage seaming, the extreme edges of both flanges in such relative positions as are desired in the completed seam, and then, as a second stage, by closely winding the following portions of both flanges, alternately, around the seam center portion formed in the first stage until the winding angle of the extreme edges of the end and body flanges reaches the desired angle using a second seaming roll whose forming groove has a radius of curvature larger than that of the first seaming roll or whose forming groove has a radius of curvature larger than that of the first seaming roll and, at the same time, a cross-sectional curve identical to the contour of the desired seam, and a method of manufacturing a seamed metal container comprising combinations of various manufacturing methods described in the foregoing.

An apparatus for manufacturing a seamed metal container which comprises a seaming roll and a chuck ring each of which has a forming groove comprising an circular arc or a plurality of circular arcs, when viewed in profile, in which the seaming roll and the chuck ring are set in such a manner that at least a center distance between at least a center of curvature of the arc or arcs on the forming groove of the seaming roll and at least a center of curvature of the arc or arcs on the forming groove of the chuck ring falls, on completion of seaming, into $\frac{1}{2}$ of the sum of the thicknesses of the metal sheets making up a seam of the container, in which the seaming roll or each of the seaming roll and the chuck ring has a forming groove comprising a plurality of continuous circular arcs two of which have a center distance equal to $\frac{1}{2}$ of the sum of the thicknesses of two metal sheets making up the seam, when viewed in profile.

An apparatus for manufacturing a seamed metal container which comprises a seaming roll having a forming groove which consists of a plurality of continuous arcs each having a center angle between 0 degree and smaller than 180 degrees which are separated from each other by a center-to-center distance equal to $\frac{1}{2}$ of the sum of the thicknesses of two metal sheets that make up a desired seam of the container, when viewed in profile, or a forming groove which cross-sectionally consists of a first arc whose center angle is more than 90 degrees beyond the base line of the forming groove perpendicular to the direction in which the seaming roll operates and one or more arcs continuous with said first arc or continuous with not only said first arc but also each other, with the sum of the center angles of the first and adjoining arcs being equal to or less than 180 degrees, or a forming groove which comprises a first arc or a first group of continuous arcs starting from said base line with the sum of the center angles thereof being more than 90 degrees and one or more continuous arcs adjoining said first arc or first group of arcs, with the total sum of the center angles of the whole arcs being equal to or less than 180 degrees, or a forming groove which cross-sectionally consists of a plurality of continuous arcs, and the radius of curvature of at least one of the arcs is equal to the sum of the minimum radius of curvature on the inside of the body flange and the thicknesses of the body flange and end closure flange making up the desired seam.

The two metal sheets or two kinds of metal sheets or a plurality of metal sheets making up the seam are an end closure flange and a body flange, each flange can be made up of one or more metal sheets or a combination of one or more metal sheets and sheets of other material than metal.

The seam of a metal container can get damaged when the continer falls on or strikes against other object. Especially then a container falls diagonally, its seam tends to deform parallel to the hitting surface, as a result of which the metal sheets making up the seam often separate from each other under the influence of a twisting force working on the boundary between the deformed and undeformed portions. Made up of continuous groups of concentric arcs, the seams according to this invention offer greater resistance to such twist and separation than the conventional seams involving straight portions. Filled with less sealing compound and having no undesirable gaps, the seams of this invention have greater strength and need smaller quantities of metal sheets than the conventional ones.

According to this invention, it is also practicable, by omitting a part of the arcs in the center portion, to lower the manufacturing cost of seamed containers through the reduction of metal sheets used, although the quantity of sealing compound increases and the container strength drops.

With the use of a method and apparatus for manufacturing a seamed metal container according to this invention, a plurality of metal sheets, such as an end sheet and a body sheet, making up a seam are formed into a plurality of continuous arcs along one or more arcs of the forming grooves on a seaming roll and a chuck ring, and into two continuous groups of concentric circular arcs centered on two points separated from each other by a distance equal to ½ of the sum of the thicknesses of the end and body sheets, into a shape of point symmetry making the middle point between the two centers of said two concentric circular arc groups as a center of symmetry. Therefore, the inside of the end sheet formed along the forming groove of the seaming roll and chuck ring and the outside of the body sheet formed along the inside of said end sheet as well as the outside of the end sheet and the inside of the body sheet are continuously formed to have the same radius of curvature at all times. Seaming is carried out smoothly and easily, bringing both sheets into uniform, tight contact with each other. It is also feasible to theoretically calculate, with exactness and ease, the lengths of both end closure flange and body flange for temporary fitting prior to the start of seaming. With the conventional manufacturing methods, it has been impossible to make such theoretical calculation because both flanges apt to undergo irregular deformation, which, in turn, resulted in the formation of an unstable seam center portion and the creation of an undesirable gap between the two flanges.

A method of manufacturing a seamed metal container of this invention forms the enter portion of a desired seam at a certain desired transition point or winding angle during the seaming process from the start to the completion of the seaming operation, and then tightly winds the following portions of both body and end closure flanges around said center portion, alternately, to form such two continuous groups of concentric circular arcs comprising a shape of point symmetry having a center of symmetry which is the middle point between the two centers of said two concentric circular arcs. Seaming is accomplished smoothly and easily, with the center portion of the seam formed by the edge portions of both flanges remaining substantially underformed during the following course of the seaming operation. With the conventional manufacturing methods, by contrast, the center portion of a seam is formed when seaming is completed, with the extreme edges and edge portions of end closure flange and body flange striking against the outer opposite flanges toward the end of the seaming operation. Therefore, the edge portions of the two flanges will undergo unstable and irregular deformation, and the completed center and its adjacent portion of the seam will have an unstable, irregular structure and shape, containing an undesirable gap.

A method of manufacturing a seamed metal container according to this invention forms the center portion of a seam, smoothly, easily and regularly, while the seaming operation is in progress, and then winds the following portions of the end closure and body flanges around the seam center portion that remains substantially undeformed. Therefore, the seam formed, especially the center portion and its adjoining portion thereof, has a stable, regular structure free of any undesirable gap.

A method of manufacturing a seamed metal container of this invention is capable of continuously making seams having various number of folds with various winding angles with the use of various rolls or only two seaming rolls. It is also practicable to theoretically calculate and set, with exactness and ease, the length, straight and curved portions of both end closure and body flanges that are necessary for temporary fitting. With the conventional seaming methods, making different seams calls for the use of individually different seaming rolls. Besides, it is impracticable to theoretically calculate the length, straight and curved portions of both flanges for temporary fitting. This has been due to the difficulty in obtaining stably, regularly and equally shaped seams and ajoining portions because of the irregular deformation of the metal sheets making up the seam.

The gap in the seam is not only impairs the strength and leak-proofness of the seam but also decreases the economy by increasing the required length of both flanges and, therefore, the required quantity of metal sheets.

According to a method of manufacturing a seamed metal container of this invention, formation of the seam center portion during the seaming process can be made smoother and easier by pre-curling the edge portion of the body flange before temporarily fitting the end and body sheets prior to the start of seaming.

DETAILED DESCRIPTION OF THE PREFERRED EMBODIMENTS

Now, the seamed metal containers and their manufacturing methods and apparatuses according to this invention will be described with reference to the accompanying drawings.

Figure 1A:
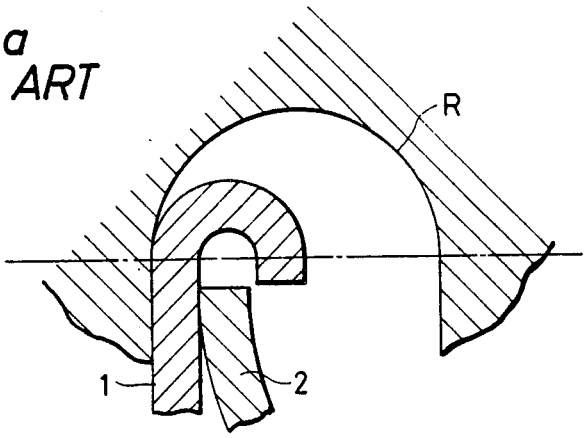
FIG. 1a PRIOR ART
FIGS. 1*a* through 1*c* show how a conventional five-fold seam is formed, the three sketches showing the stages in which seaming begins, approaches completion, and completes, respectively.
Figure 1B:
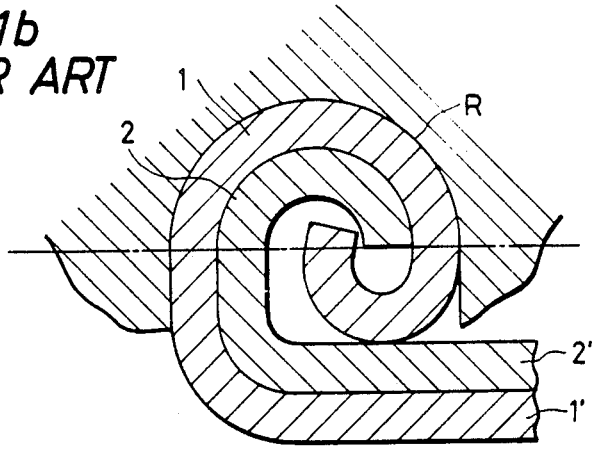
FIG. 1b PRIOR ART
Figure 1C:
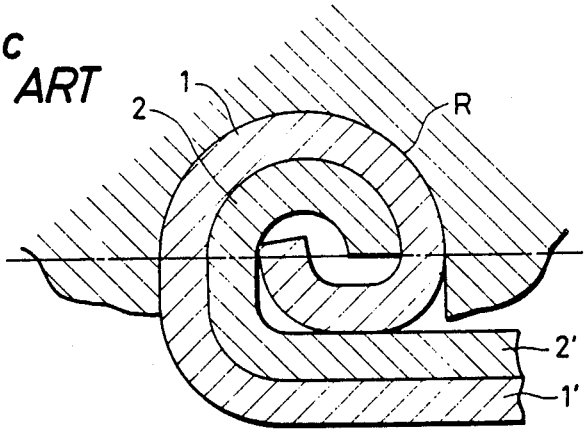
FIG. 1c PRIOR ART
Figure 2A:
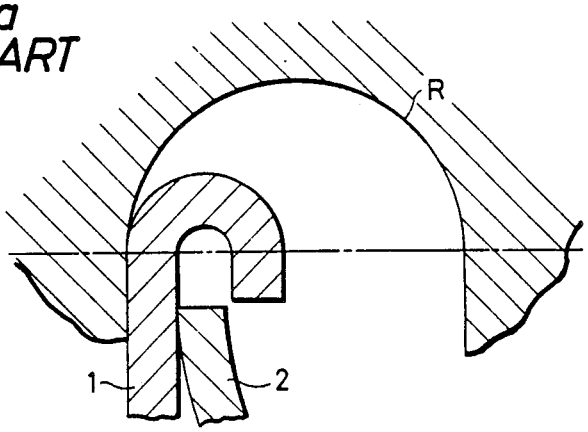
FIG. 2a PRIOR ART
FIGS. 2*a* through 2*c* show how a conventional seven-fold seam is formed, the three sketches showing the stages in which seaming begins, approaches completion, and completes, respectively.
Figure 2B:
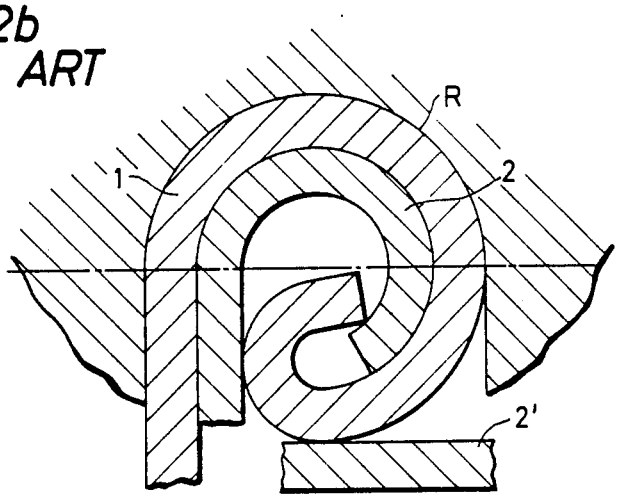
FIG. 2b PRIOR ART
Figure 2C:
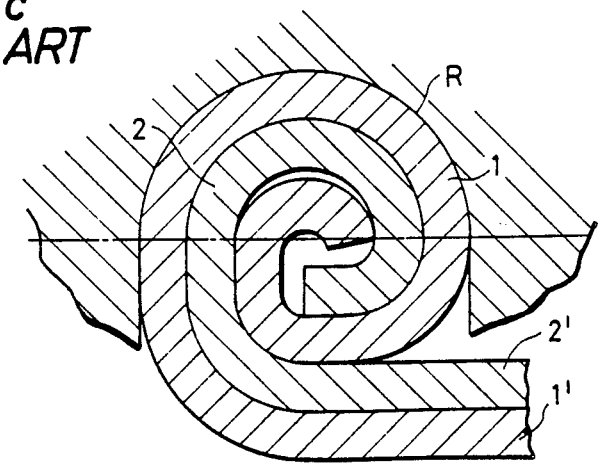
FIG. 2c PRIOR ART
Figure 3:
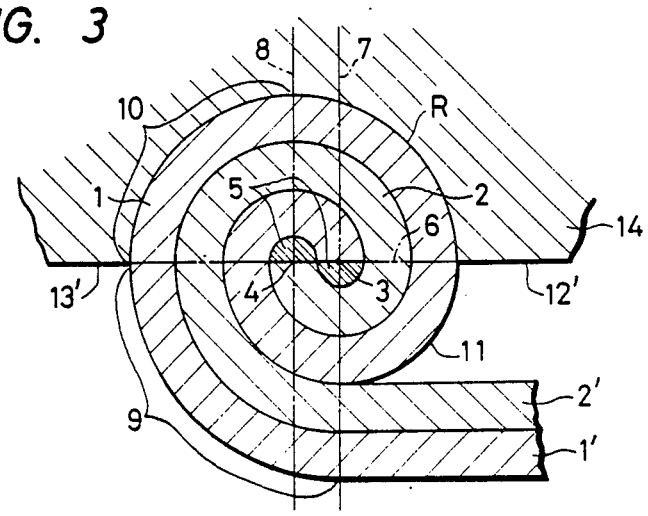
FIG. 3 is a cross-sectional view showing a seven-fold seam according to this invention.

FIG. 3 is a cross-sectional view showing the seam of a metal container according to this invention. Reference numerals 1 and 2 designate an end closure flange and a body flange making up the seam. The end closure and body flanges 1 and 2 are respectively followed by an end sheet proper 1' and a body sheet proper 2' (which becomes the container body) parallel to the axis of the container to be formed. Both flanges 1 and 2 are wound into two continuous groups of concentric arcs around common centers 3 and 4 at the side of the extreme edge of the end closure and body flanges. Reference numeral 5 shows where a sealing compound is filled at the center portion of the seam. A straight line 6 passes through the two common centers 3 and 4, while straight lines 7 and 8 are perpendicular to the axis of the container and pass through the centers 3 and 4 of said continuous groups of concentric circular arcs, respectively. Reference numeral 9 shows the outermost layer of the largest sector (having the center 3) on the container side cut off by said two straight lines 6 and 7. Reference numeral 10 denotes the outermost layer of the sector (having the center 4) on that side which is opposite to the container and does not include the straight line 7, defined by said straight lines 6 and 8. Reference numeral 11 designates the outermost layer of the smallest sector on the container side defined by said straight lines 6 and 7.

Reference numeral 12' and 13' indicate the lower ends of a seaming roll 14. The forming groove R of the seaming roll 14 may be followed by a vertical wall, in which case, however, the lower ends 12' and 13' do not extend flush with the straight line 6 but approach the container body proper, and the upper end of the chuck ring opposite to the seaming roll 14 may be made into a fillet.

The extreme edges of the end closure flange 1 and body flange 2 are wound and seamed over 630 degrees and 450 degrees, respectively, with respect to the axis of the container. The seam-forming portions of both flanges 1 and 2 are closely and alternately seamed together except semi-circular gaps left at the center portion of the seam (where sealing compounds are filled). The flanges 1 and 2 shown as the same thickness in FIG. 3 form substantially continuous two groups of concentric circular arcs, one of which having a common center 3 and lying under the straight line 6 while the other having a common center 4 and lying on the straight line 6. The continuous two groups of concentric arcs are made up of arcs made about said two common centers 3 and 4 and each having a center angle of 180 degrees and 90 degrees, and of 180 degrees, respectively. The common centers 3 and 4 are separated from each other by a distance equal to $\frac{1}{2}$ of the sum of the thicknesses of the end closure and body flanges, positioned at the center of the thickness of the extreme edges of both flanges 1 and 2. The minimum radius of curvature in the groups of concentric arcs formed by both flanges 1 and 2 is 0.5 times the thickness of the end closure or body flange 1 or 2, while the minimum radius of curvature at the center of sheet thickness is 1.0 times the same thickness. The seam is made up of two continuous groups of concentric arcs formed by closely and alternately wound flanges 1 and 2. The straight line 6 passing through said two centers 3 and 4, about which said groups of concentric arcs are formed, extends parallel to the axis of the container. The shape of the seam has a shape of point symmetry making the middle point between said centers 3 and 4 as a center of symmetry, except portions 9 and 10 of the outermost layer thereof. The centers 3 and 4 of the two groups of concentric arcs making up the seam rest on the straight line 6, separated from each other by a center distance equal to $\frac{1}{2}$ of the sum of the thicknesses of the end closure and body flanges. About the center 3 are formed a group of concentric arcs lying on that side of the straight line 6 which is closer to the container. On the other hand, a group of concentric arcs lying on the farther side are formed about the center 4. Since the seam shown in FIG. 3 is made up of two continuous groups of concentric arcs having the common centers, the exact required lengths of both flanges 1 and 2 can be calculated theoretically. The length of the line at the center of the thickness of the end closure flange between the point where the bend begins at the end of the straight portion 1' and the extreme edge thereof is equal to $$(\text{Thickness of end closure flange}) \times 8\pi$$

Likewise, the length of the line at the center of the thickness of the body flange between the point where the bend begins at the end of the straight portion 2' and the extreme edge thereof is equal to $$(\text{Thickness of body flange}) \times 4.5\pi$$

FIG. 3 exemplifies a seam according to this invention. The seam of this invention is not limited in the angles about which the extreme edges of both flanges are wound, the minimum radius of curvature of the two groups of concentric arcs formed by a plurality of metal sheets making up the seam, the thickness of said metal sheets, and so on. In FIG. 3, the end closure flange has the same thickness as the body flange, but their thickness is not limited but may differ from each other. Even when their thickness differs, a similar structure can be obtained, although the two centers of the two groups of concentric arcs are not located at the center of the thickness of both flanges.

Usually, the seam of a seamed metal container gets damaged when the container falls on other object. Especially when a container falls diagonally, its seam is deformed parallel to the surface upon which it has fallen, whereupon the boundary between the parallel portion and other portion becomes twisted. On many such occasions, the outermost layer 9 of the largest arc, the end closure flange 1' and the smallest arc 11 separate from the body flange 2 and 2'.

The seams of this invention, like the one shown in FIG. 3, resist such separation, including that of the smallest arc 11, throughout the whole circumference of the groups of concentric arcs made by the seam-forming metal sheets. The weakest point of the seam where said twist occurs has a substantially uniform strength in all directions. When falling upon other object, the portion 10 defined by the straight lines 6 and 8 receives the heaviest impact, but both flanges making up the seam cling to each other tighter to offer a strong resistance to said separating force. It offers strong resistance to the twisting force as well, both in a direction in which the seam tightens and in a direction in which it loosens. A gap at the center portion of the seam is extremely small because the minimum radius of curvature of the groups of concentric arcs formed by both flanges 1 and 2 at the seam center portion is 0.5 times the thickness of the end closure flange 1 or the body flange 2. As a consequence of this, the contour of the seam is ideally small, in view of the winding angle and the number of layers of both flanges 1 and 2. The quantity of a sealing compound filled in the gap at the seam center portion and the quantity of both flanges 1 and 2 required are also ideally small.

FIGS. 4*a* through 13 are cross-sectional views showing other examples of seams according to this invention.

Figure 4A:
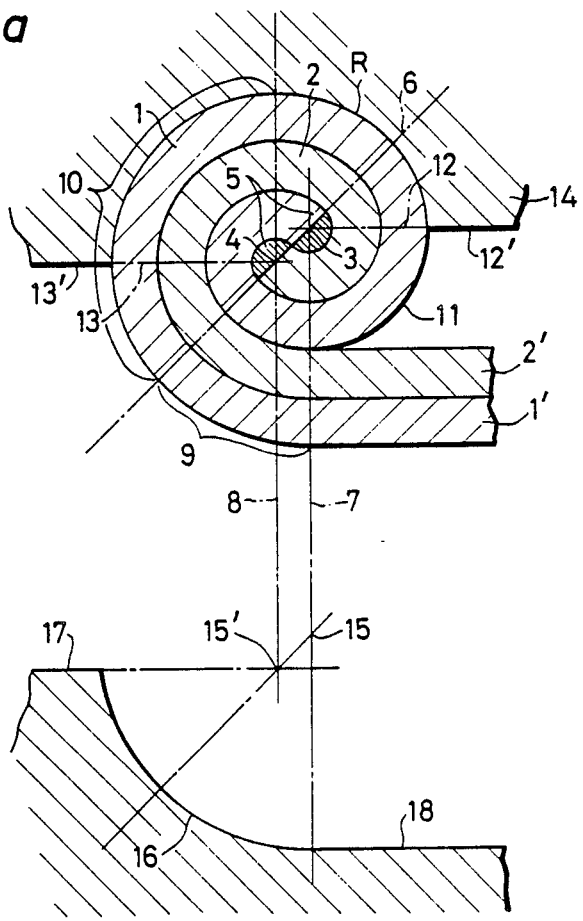
FIGS. 4*a* and 4*b* are cross-sectional views showing other seven-fold seams according to this invention, with the extreme edges of the flanges being wound over different angles with respect to the axis of the container.

FIG. 4*a* shows a seam in which the straight line 6 passing through the two centers of said two groups of concentric arcs inclines 45 degrees, in a direction opposite to the seaming direction, with respect to the axis of the container. With respect to the container axis, the extreme edges of the end closure flange 1 and body flange 2 are wound about 585 degrees and 405 degrees, respectively. In FIG. 4*a*, reference characters 1 through 11, 12', 13', 14 and R denote items similar to those shown in FIG. 3. A straight line 12, indicated by a one point chain line, is parallel to the container axis, passing through the common center 3 residing at the center of the thickness of the extreme edge of the end closure flange 1, about which the groups of concentric arcs on the container side of the straight line 6 are formed. A straight line 13, indicated by a one point chain line, is parallel to the container axis, passing through the common center 4 residing at the center of the thickness of the extreme edge of the body flange 2, about which the groups of concentric arcs on that side of the straight line 6 which is opposite to the container are formed. Reference numerals 12' and 13' designate the lower ends of the forming groove R of the seaming roll 14. Reference numerals 15 and 15' indicate the centers of the radii of curvature of the arc-shaped groove of the chuck ring corresponding to the portions 9 and 10 of the seam. The forming groove 16 of the chuck ring corresponds to the forming groove R of the seaming roll, consisting of two continuous concentric circular arcs having two centers 15 and 15' which are separated from each other by a center distance equal to $\frac{1}{2}$ of the sum of the thicknesses of the end closure and body flanges. Reference numeral 17 indicates the upper end of the chuck ring which corresponds to the lower end 13' of the seaming roll, while reference numeral 18 denotes the groove bottom continuing to the groove 16 of the chuck ring. The arrangement of the lower ends 12' and 13' of the seaming roll 14 and the upper end 17 of the chuck ring is not limited to the one illustrated. It is possible, for example, to provide a vertical wall next to the forming groove R of the seaming roll 14. In this case, the lower ends 12' and 13' do not lie flush with the straight lines 12 and 13, approaching the container body instead. The upper end 17 of the chuck ring corresponding to the seaming roll 14 may be formed into a fillet.

The seam has a shape of point symmetry making the middle point between said centers 3 and 4 as a center of symmetry, except the portions 9 and 10 of the outermost layer thereof. This seam has practically high enough strength and resistance to unseaming according to a use, although the strength and resistance are lower than those of the seam shown in FIG. 3 because of the smaller number of windings. On the other hand, the seam size and the requirement of both flanges 1 and 2 are proportionally smaller. Other conditions of the seam are the same as those shown in FIG. 3. This seam is formed by a method that is slightly different from the one for the seam of FIG. 3, as will be described later.

Figure 4B:
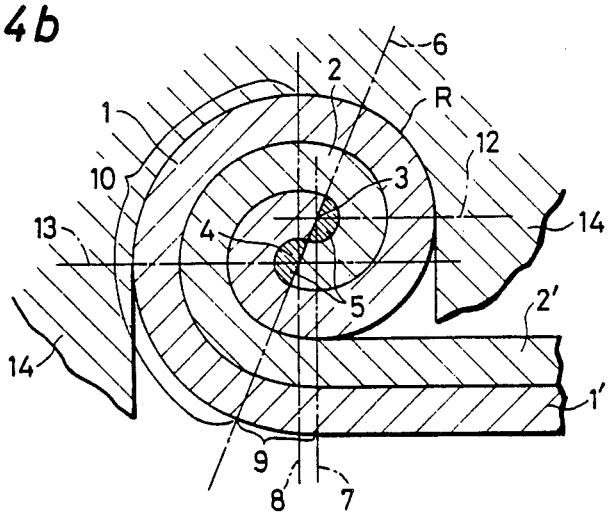

While the straight line 6 is inclined 45 degrees on behalf of an angle of between over zero degree and less than 90 degrees with respect to the container axis and the extreme edges of the flanges 1 and 2 are respectively wound, with respect to the container axis, about an angle of less than 630 degrees and over 540 degrees and of less than 450 degrees and over 360 degrees in FIG. 4*a*, they are wound about an angle of 562.5 degrees and 382.5 degrees, with the straight line 6 being inclined 67.5 degrees (or 112.5 degrees) with respect to the container axis in FIG. 4*b*.

Figure 5:
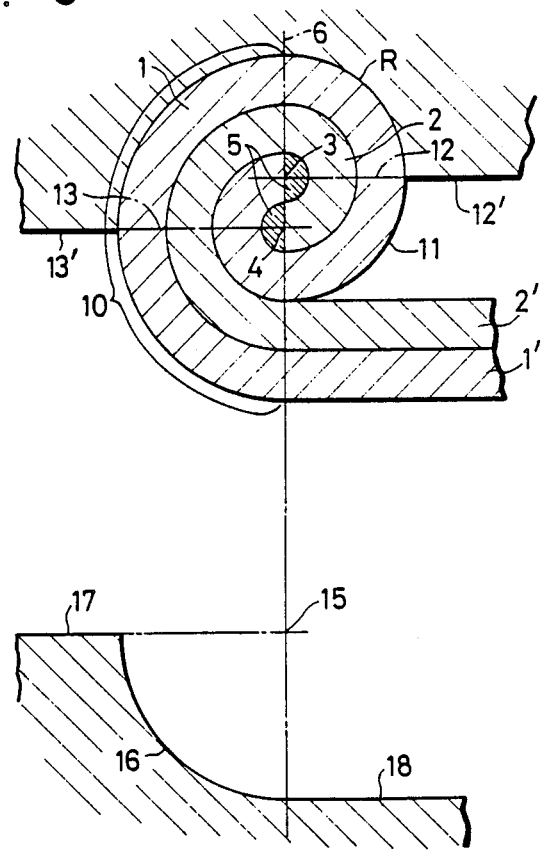
FIG. 5 is a cross-sectional view showing another seven-fold seam according to this invention.

FIG. 5 shows a seam in which the straight line 6 passing through the centers of the two groups of concentric arcs is perpendicular to the axis of the container, with respect to which the extreme edges of the end closure and body flanges are wound over 540 degrees and 360 degrees, respectively. This seam has a shape of point symmetry making the middle point between the centers 3 and 4 as a center of symmetry, except the outermost layer 10 of that portion which lies on the left of the straight line 6. This seam is substantially similar to the one shown in FIG. 4*a*, except that it exhibits the limit of what is known as a seven-fold seam (or triple seam). The straight lines 7 and 8 shown in FIG. 4*a* agree with the straight line 6 in FIG. 5.

Figure 6:
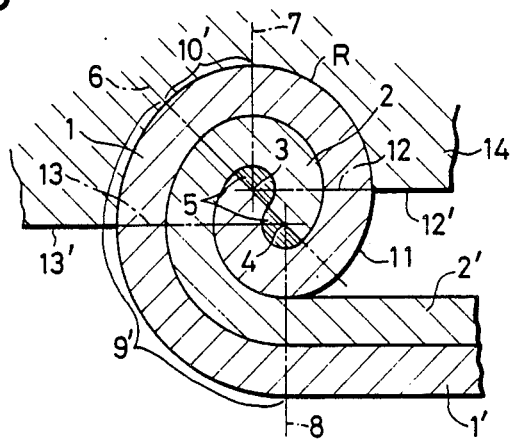
FIGS. 6 through 8 are cross-sectional views showing different five-fold seams according to this invention, with the extreme edges of the flanges being wound over different angles with respect to the axis of the container.

FIG. 6 shows a seam in which the straight line 6 is inclined 135 degrees with respect to the axis of the container in a direction opposite to the seaming direction. With respect to the container axis, the straight line 6 is inclined 135 degrees on behalf of an angle of between over 90 degrees and less than 180 degrees and the extreme edges of the end closure and body flanges 1 and 2 are respectively wound over an angle ranging between less than 540 degrees and over 450 degrees and between less than 360 degrees and over 270 degrees, or more specifically over 495 degrees and 315 degrees, respectively. This seam has a shape of point symmetry making the middle point between the centers 3 and 4 as a center of symmetry, except the outermost layers 9' and 10' thereof. The centers 3 and 4 and the straight lines 7 and 8 of this seam are positioned differently from those in FIGS. 3 and 4*a*. Reference numeral 9' denotes the outermost layer of the largest sector (centered on point 4) on the container side of the seam defined by the straight lines 6 and 8, while reference numeral 10' designates the outermost layer of the sector (centering on point 3), without including the straight line 6, on the opposite side, defined by the straight lines 6 and 7. This seam stands midway between a seven-fold (triple) seam and a five-fold (double) seam. In other respects, it is analogous to the seam shown in FIG. 4*a*.

Figure 7:
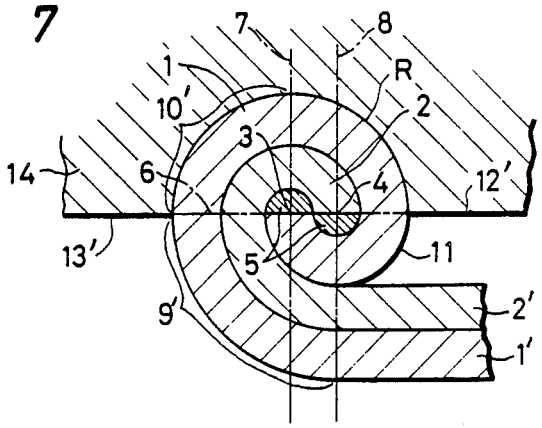

FIG. 7 shows a five-fold (double) seam resembling the one shown in FIG. 3, with the straight line 6 extending parallel to the axis of the container and the extreme edges of the end closure and body flanges 1 and 2 wound, with respect to the container axis, over 450 degrees and 270 degrees, respectively. This seam is analogous to the one shown in FIG. 3, except in the number of windings and, therefore, the position of the common centers 3 and 4 and the straight lines 7 and 8. So this seam is useful where a five-fold seam suffices.

Figure 8:
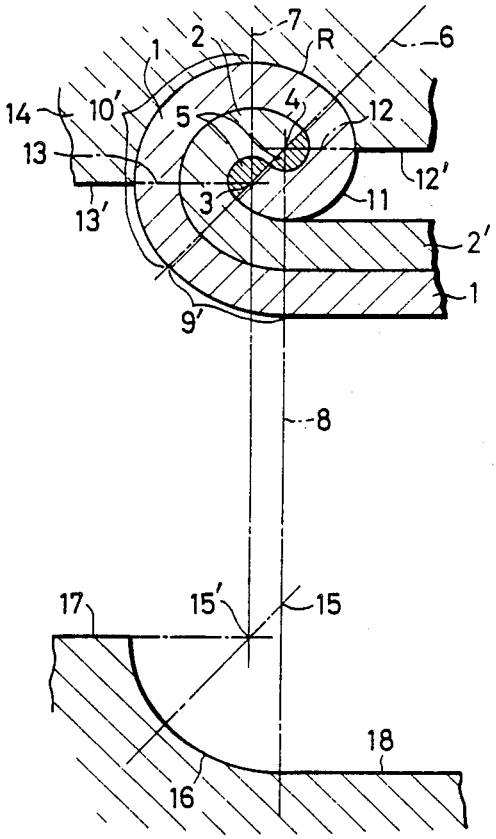

FIG. 8 shows a seam approaching the limit of the five-fold seam resembling the one shown in FIG. 4 in which the straight line 6 is inclined 45 degrees on behalf of an angle of between over zero degree and less than 90 degrees, with respect to the axis of the container, in a direction opposite to the winding direction, with the extreme edges of the end closure and body flanges 1 and 2 wound, with respect to the container axis, over an angle of between less than 450 degrees and over 360 degrees and between less than 270 degrees and over 180 degrees, or more specifically over 405 degrees and 225 degrees, respectively. If the winding angle of the extreme edge of the body flange 2 is made smaller than 225 degrees, the resistance to the force to separate the smallest circular arc 11 from the straight portion 2' of the body flange weakens.

As shown in FIGS. 3 through 8, the winding angle and the number of windings of the seams according to this invention are not limited but may be chosen as desired. The straight line passing through the two centers of said two concentric circular arc groups has an angle of inclination able to be placed at any angle to the axis of the container, and then the desired various seams are formed having said desired angle of inclination, the desired winding angle and desired number of layers according to this invention. Said angle of inclination may be placed at any angle as desired.

Figure 9:
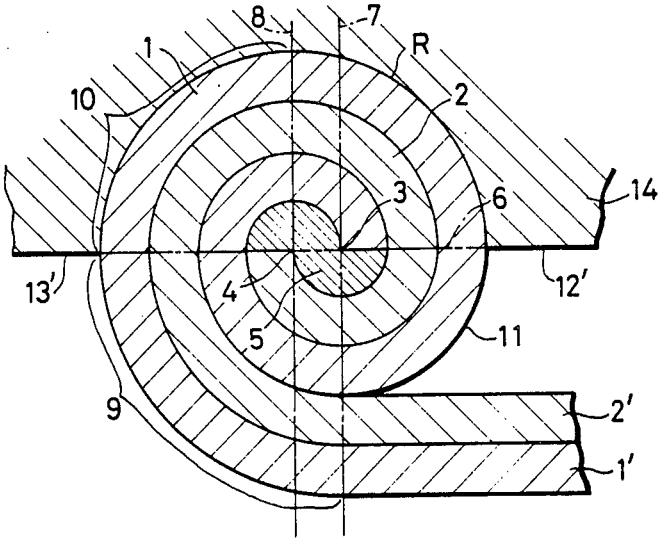
FIG. 9 is a cross-sectional view showing another seven-fold seam according to this invention.

FIG. 9 is a cross-sectional view showing a seam in which the minimum radius of curvature of said two groups of concentric circular arcs is equal to the thickness of the end closure flange or the body flange and the minimum radius of curvature at the center of the sheet thickness is 1.5 times the sheet thickness. The seam shown in FIG. 9 is analogous to the one in FIG. 3, and can likewise be made into seams resembling those shown in FIGS. 4*a* through 8 whose minimum radius of curvature is 1.0 times the thickness of the end closure flange or the body flange.

Figure 10:
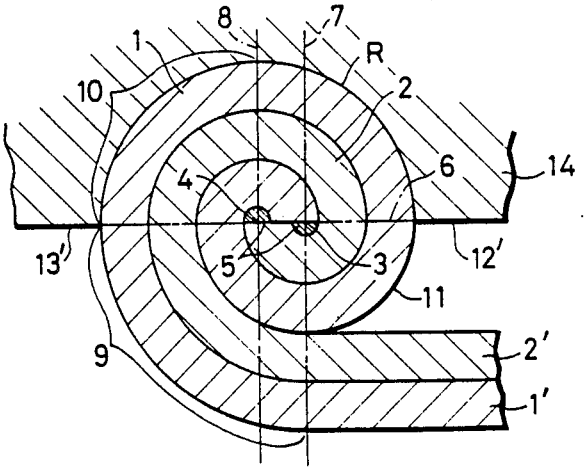
FIG. 10 is a cross-sectional view showing still another seven-fold seam according to this invention.

FIG. 10 is a cross-sectional view showing a seam in which the minimum radius of curvature of said two groups of concentric circular arcs is 0.3 times the thickness of the end closure flange and the minimum radius of curvature at the center of the sheet thickness is 0.8 times the sheet thickness. The seam shown in FIG. 10 is analogous to the one in FIG. 3, and can likewise be made into seams resembling those shown in FIGS. 4*a* through 8 whose minimum radius of curvature is 0.3 times the thickness of the end closure flange.

The minimum radius of curvature of the two groups of concentric circular arcs making up the seams of this invention is not limited to those described above. Yet, it is technically difficult to make the minimum radius of curvature smaller than 0.5 times the thickness of the end closure flange. On the other hand, making the minimum radius of curvature larger than 1.0 times the thickness of the end closure flange, though technically easy, results in a larger seam, requires more end closure and body flanges 1 and 2 and more sealing compound, and possibly leaves a larger gap at the center portion of the seam. All this increases the production cost of containers and impairs their airtightness.

Figure 11:
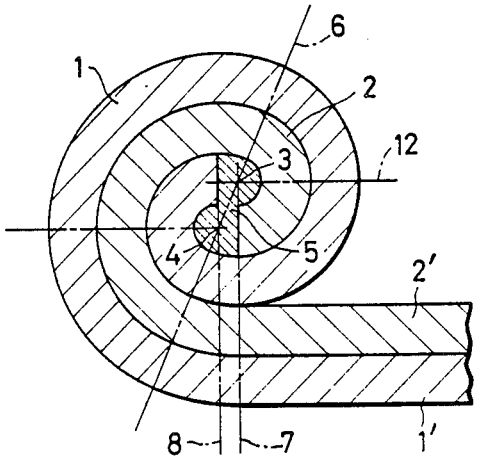
FIGS. 11 through 13 are cross-sectional views showing other seams according to this invention whose number of folds falling between five and seven, with the edge portions of the flanges being omitted over different center angles in the center portions of the seams.

FIG. 11 shows a seam whose two groups of concentric circular arcs have the same radius of curvature as the seam shown in FIG. 4*b*, but the center angle thereof is not 180 degrees but 157.5 degrees in the circular arcs having the minimum radius of curvature in the center portion of the seam. Compared with the one shown in FIG. 4*b*, the seam of FIG. 11 requires more sealing compound but less metal sheets, offering greater economy at the expense of seam strength. In the seam shown in FIG. 11, both of the two circular arcs at the edges of both flanges are formed with the same center angle of 157.5 degrees. It is also possible to form either or both of the two circular arcs with a center angle of 0 degree to 180 degrees.

Figure 12:
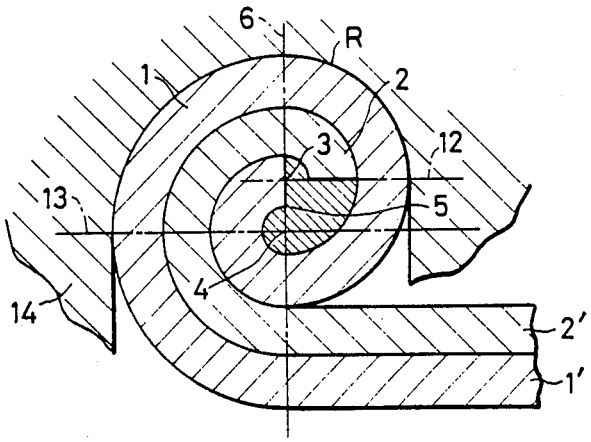

FIG. 12 shows a seam in which the straight line 6 passing through the common centers 3 and 4 of the groups of concentric circular arcs is perpendicular to the axis of the container, and the extreme edges of the end closure and body flanges 1 and 2 are wound, with respect to the container axis, over 540 degrees and 270 degrees, respectively. The circular arcs having the minimum radius of curvature at the center portion of the seam has a center angle of 180 degrees at the edge of the end closure flange and 90 degrees at the edge of the body flange.

Figure 13:
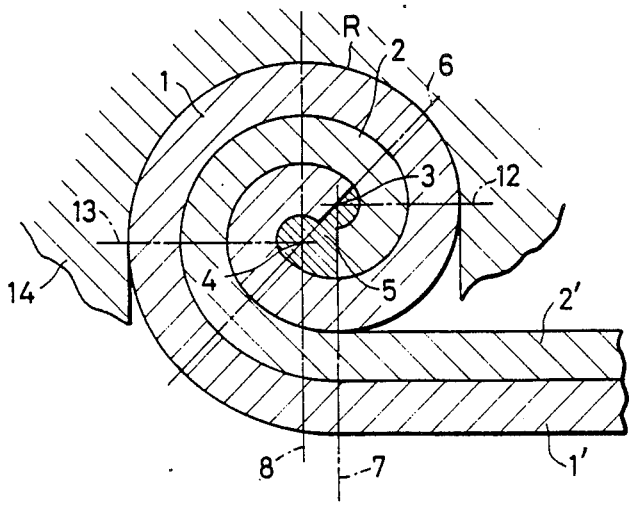

FIG. 13 shows a seam in which the straight line 6 passing through the common centers 3 and 4 of the groups of concentric circular arcs is inclined 45 degrees or 135 degrees with respect to the axis of the container, and the extreme edges of the end closure and body flanges 1 and 2 are wound, with respect to the container axis, over 585 degrees and 360 degrees, respectively. The circular arcs having the minimum radius of curvature at the center portion of the seam has a center angle of 180 degrees at the edge of the end closure flange and 135 degrees at the edge of the body flange.

While the seam shown in, for example, FIG. 4*b*, is seven-fold, the seams of FIGS. 12 and 13 stand midway between six-fold and seven-fold. The seams of FIGS. 12 and 13 are similar to those of FIGS. 5 and 4*a*, except that part of the circular arcs at the edge of the body flange is missing. It is practicable to form a six-fold seam by reducing the center angle of the circular arc having the minimum radius of curvature at the center portion of the seam, that is, for example, the center angle of 135 degrees of the circular arc at the edge of the body flange 2 in FIG. 13, to zero and positioning the extreme edge of the body flange 2 on the straight line 6 passing through the common centers 3 and 4 of the groups of concentric circular arcs. Like the one shown in FIG. 11, the seams of FIGS. 12 and 13 require less metal sheets than the seams of FIGS. 5 and 4*a*. This is an example in which the edge of the end closure flange 1 is seamed with the body flange 2 in such a manner to provide adequate strength to withstand the force to which the container is subjected when falling upon other object. In the seams shown in FIGS. 3 through 10, like those of FIGS. 11 to 13, either or both of the circular arcs having the minimum radius of curvature at the seam center portion may have a center angle of 0 degree to 180 degrees.

In the seams shown in FIGS. 3 through 8 and FIGS. 11 through 13, the radii of curvature of the circular arcs at the edges of both flanges 1 and 2 are 1.0 times the thickness of both flanges at the center of the flange thickness, and, therefore, the minimum radius of curvature is the one on the inside of said circular arc that is 0.5 times the thickness of both flanges. When a sheet is bent with a radius of curvature smaller comparing the thickness of the sheet, the thickness of the formed portion sometimes increases after bending. This invention permits determining the radius of curvature of the circular arc at the center portion of the seam with the probable post-forming thickness increase in mind or decreasing, by scarfing, grinding or otherwise, either before or after forming, the thickness of the circular arc having the minimum radius of curvature according to the amount of such a thickness increase.

Next, apparatuses and methods of manufacturing seamed metal containers according to this invention will be described by reference to accompanying drawings.

FIGS. 14 through 19 are cross-sectional views showing the main curves of the forming grooves of the seaming roll that are used in forming the seams shown in FIGS. 3 through 8 and FIGS. 12 and 13, which are basically identical with curves indicated by reference characters R, 12', 13' and 14 in the preceding figures. Reference numerals 3', 4', 6', 7' and 8' in FIGS. 14 through 19 correspond to reference numerals 3, 4, 6, 7 and 8 used in FIGS. 3 through 8 and FIGS. 12 and 13, respectively. The chuck ring paired with the seaming roll is shown in the lower portion of FIGS. 14, 4*a*, 5 and 8.

The forming grooves of the seaming rolls shown in FIGS. 15*a* through 17 and 19 and the forming grooves of the chuck rings shown in FIGS. 4*a* and 8 are each made up of two continuous circular arcs having the centers separated from each other by a distance equal to $\frac{1}{2}$ of the sum of the thicknesses of the two metal sheets composing the seam. Said two circular arcs shares the same tangent line in common at the point where they meet, and the difference between the radii of curvature thereof is equal to $\frac{1}{2}$ of the sum of the thicknesses of the two metal sheets making up the seam.

The forming grooves of the seaming roll and chuck ring of this invention each have a cross-sectional curve having one or more radii of curvature, and, as will be evident from FIGS. 3 through 19, the seaming roll and chuck ring are disposed in such a manner that the center-to-center distance between at least one of the centers of curvature of the former and at least one of the

20 centers of curvature of the latter becomes equal to $\frac{1}{2}$ of the sum of the thicknesses of the two metal sheets making up the seam upon completion of seaming.

The seams shown in FIGS. 3, 7, 9 and 10 are made with the use of seaming rolls and chuck rings whose forming grooves having such cross-sectional curves as are each made up of one circular arc. The centers of curvature of the forming grooves of the seaming roll and chuck ring are horizontal and separated from each other by a distance equal to $\frac{1}{2}$ of the sum of the thicknesses of the two seam-forming metal sheets.

For the seams shown in FIGS. 5 and 12, the centers of curvature 3, 4 and 15 of the cross-sectional curves of both forming grooves lie on a straight line perpendicular to the axis of the container: Upon completion of seaming, the center 4 coincides with the center 15, and the distance between the centers 3 and 15 becomes equal to $\frac{1}{2}$ of the sum of the thicknesses of the two seam-forming metal sheets.

For the seams shown in FIGS. 4*a*, 6 and 8, the centers of curvature 3 and 4 to the centers of curvature 15 and 15' in FIG. 4*a*, the center of curvature 4 to that of the forming groove of the chuck ring in FIG. 6, and the centers of curvature 4 and 3 to the centers of curvature 15 and 15' in FIG. 8 are oppositely positioned on a straight line perpendicular to the axis of the container. When seaming is completed, the centers of curvature 3 and 4 coincide with the centers of curvature 15 and 15' in FIG. 4*a*, the center of curvature 4 with the center of curvature of the forming groove of the chuck ring in FIG. 6,and the centers of curvature 4 and 3 with the centers of curvature 15 and 15' in FIG. 8, respectively, and the distance between the centers 3 and 15', and the centers 4 and 15 in FIG. 4*a*, the center 3 and the center of the chuck ring in FIG. 6 and the centers 3 and 15, and the centers 4 and 15' in FIG. 8 becomes equal to ½ of the sum of the thicknesses of the two seam-forming metal sheets. The seaming roll and chuck ring according to this invention are placed in the relative positions just described.

The cross-sectional curves of the forming grooves of the seaming rolls and chuck rings shown in FIGS. 3 through 19 are made up of one or more circular arcs each having a center angle of larger than 0 degree and not larger than 180 degrees and a radius of curvature that is equal to the sum of the radius of curvature on the inside of the circular arc at the edge of the end closure or body flange positioned at the center portion of the seam (or the minimum radius of curvature of the seam), the thickness of the end closure flange multiplied by the number of windings, and the thickness of the body flange multiplied by the number of windings, so as to satisfy the conditions described before.

The forming grooves of the seaming rolls shown in FIGS. 4*a*, 4*b*, 8, 15*a*, 15*b* and 19 each have a crosssectional curve consisting of a first circular arc having a center angle exceeding 90 degrees and an ajoining second circular arc, and the sum of the center angles of the two circular arcs is 180 degrees.

In FIGS. 14 through 19, the solid line indicates the cross-sectional curve of the forming groove, the one point chain line indicates the center of curvature of such cross-sectional curve and the border line between two adjoining curves, and the broken line indicates other cross-sectional curves, particularly those defined by the vertical wall that can be provided on the preceding and/or following side of the forming groove or by the fillet that can be formed at.the lower end of the seaming roll and the chuck ring.

Seams analogous to those shown in FIGS. 3 through 8 and FIGS. 11 through 13, whose radii of curvatures at the center portion of the seam are equal to that shown in FIGS. 9 and 10, can be formed with the use of such seaming rolls and chuck rings as have the forming grooves that are similar in cross section to those shown in FIGS. 3 through 19.

Now, a method of manufacturing a seamed metal container according to this invention will be described. Any combination of the seaming roll and chuck ring shown in FIGS. 3 through 19 are set as illustrated and described above. The end closure flange 1 and body flange 2 having the theoretically calculated required lengths are temporarily fitted together, and turned while being supported by the chuck ring. By depressing the seaming roll, the cross-section of both flanges 1 and 2 is formed into a plurality of circular arcs each having a center angle of 180 degrees or into a plurality of circular arcs each having a center angle of 180 degrees and a plurality of circular arcs each having a center angle of not larger than 180 degrees. Then, the circular arcs are formed into two continuous groups of concentric circular arcs centered on two points that are separated from each other by a distance equal to ½ of the sum of the thicknesses of the end closure and body sheets making up the seam, and into a shape of point symmetry making a middle point of the two centers of said two continuous groups of concentric circular arcs as a center of symmetry except some portion thereof, seaming until the straight line passing through the two centers of said two concentric arc groups has the desired angle of inclination to the axis of the container and the desired windings and layers are reached. The surface of the corresponding end closure and body sheets are continuously formed so as to have the same radius of curvature at all times. Seaming is accomplished easily and smoothly. The end closure and body sheets are held in close contact with each other, leaving no undesirable gap therebetween.

The seam shown in FIG. 3 can be formed, for example, by temporarily fitting together both flanges 1 and 2 under the appropriate condition for said seam, as follows; Then, a seam shown in FIGS. 4*a* through 8 is formed at the edge portions of the flanges 1 and 2, as a first step, using a seaming roll shown in FIGS. 4*a* through 8 or FIGS. 15*a* through 19. Then, as a second step, the seam is continuously finished into the desired form as shown in FIG. 3 with the use of a seaming roll shown in FIGS. 3 and 14.

Likewise, any seam shown in FIGS. 4*a* through 8 can be formed by making, as a first step, a seam with a smaller number of windings than the desired seam at the edge portions of both flanges, using a seaming roll shown in FIGS. 16 through 19. The smaller seam is then continuously finished into a larger seam of the desired shape using a corresponding seaming roll.

Also, various seams shown in FIGS. 3 through 8 can be formed by making, as a first step, a seam with a smaller number of windings than desired at the edge portions of both flanges, using a seaming roll shown in FIGS. 15*a* through 19. Then, as a second step, the seam is finished with the use of a seaming roll designed to form a seam having a larger number of windings than desired.

A method of manufacturing a seamed metal container according to this invention comprises the steps of forming the center portion of the desired seam or the seam smaller than the desired seam on the edge portions of the flanges, and then winding the following flanges around said center portion or said smaller seam, forming said center portion or said smaller seam into the desired seam.

A method of manufacturing a seamed metal container according to this invention comprises the steps of placing the flanges of the end and body under such proper temporarily fitting condition that the straight line passing through the two centers of said two concentric circular arc groups has the desired angle of inclination to the axis of the container and the desired windings and the desired layers of the desired seam are reached upon completion of the seaming. Said windings, winding layers, and angle of inclination are able to be placed at any values.

FIGS. 20 through 28 are cross-sectional views showing other methods of manufacturing seamed metal containers according to this invention.

Figure 20:
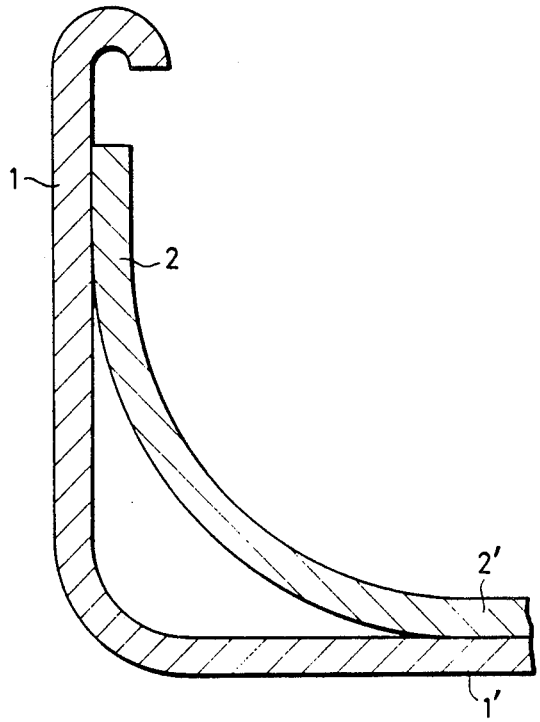
FIG. 20 shows the end closure flange and body flange temporarily fitted together according to a manufacturing method of this invention.

FIG. 20 shows how the end closure flange and body flange are temporarily fitted together prior to the start of the seaming operation to form the seam shown in FIG. 4*b*. The edge portion of the end closure flange 1 pre-curled into a circular arc having a center angle of 180 degrees. This pre-curling can be achieved as at first stage by use of an edge-bending roll provided in the seaming roll. In this figure, the curved portion between the end closure flange 1 and the end sheet 1' is identical with the curve of the seam. However, any appropriate radius of curvature may be chosen for the curved portion at the time when both flanges are temporarily fitted together. Then, the radius of curvature of the curved portion of the body flange 2 may be determined according to the preset radius of curvature. In FIG. 20, the length of the straight portion of the end closure flange 1 is 3.875$\pi$ times the thickness thereof, while the length of the straight portion and the radius of curvature at the center of thickness of the body flange 2 are 2.82 times and 9.46 times the thickness thereof, respectively.

Figure 15A:
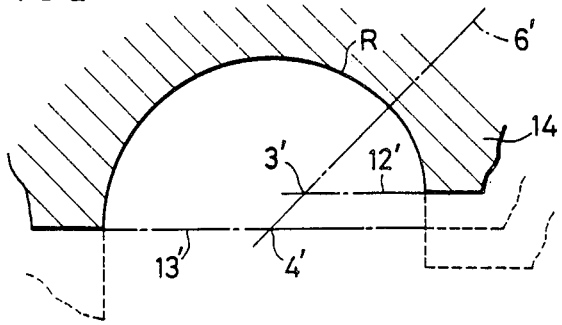
FIGS. 15*a* and 15*b* are cross-sections of rolls for making the seams shown in FIGS. 4*a* and 4*b;*
Figure 15B:
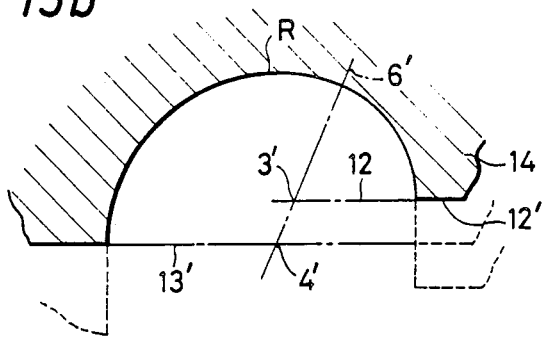
Figure 16:
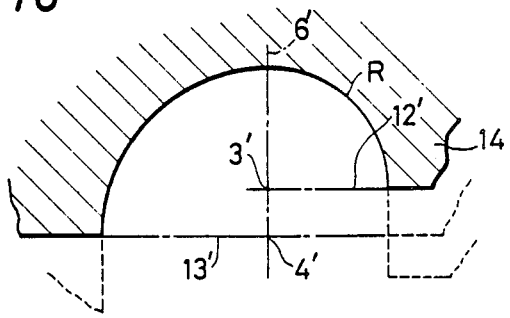
FIGS. 16 through 19 are cross-sections of rolls for making the seams shown in FIGS. 5 through 8.
Figure 21:
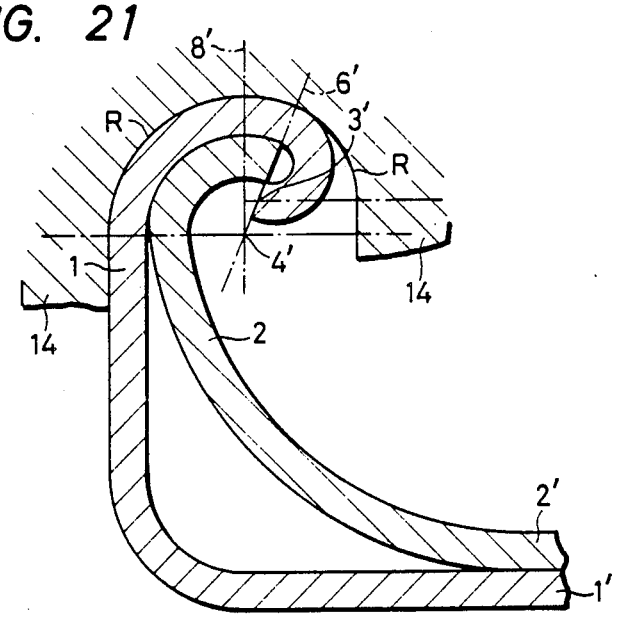
FIGS. 21 and 22 respectively show the seaming stages following the temporary fitting stages shown in FIGS. 20 and 23.
Figure 22:
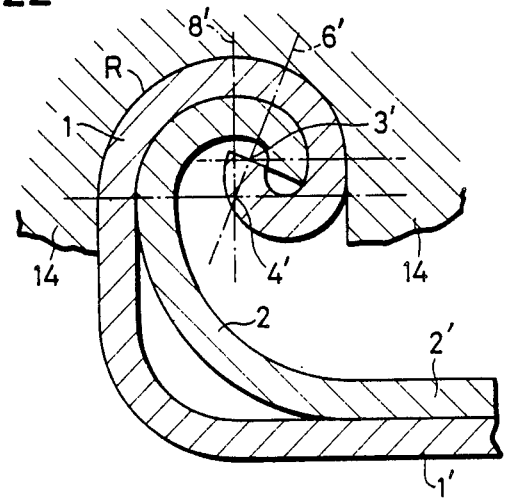
Figure 23:
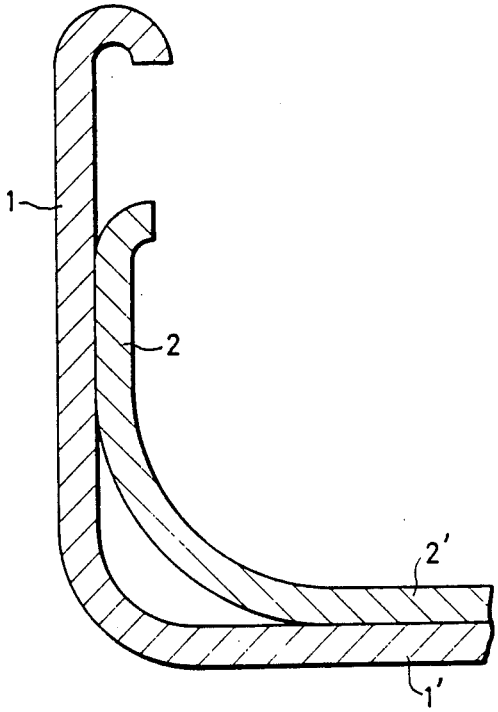
FIG. 23 shows the end closure flange and body flange temporarily fitted together according to another manufacturing method of this invention.
Figure 29:
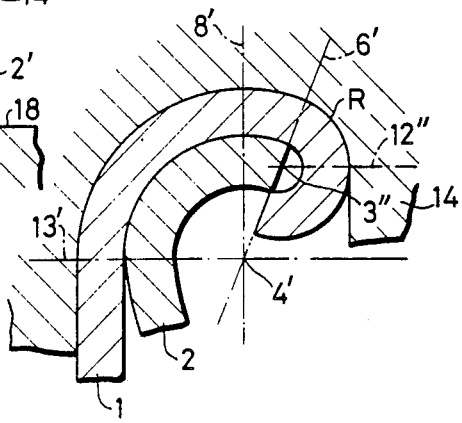
FIGS. 29 and 30 show seaming processes and rolls which are respectively different from those shown in FIGS. 21 and 24.

FIG. 21 shows a process point during the seaming process and a condition in that point in which, following the temporary fitting achieved in FIG. 20, the extreme edge of the body flange 2 has been wound over 112.5 degrees from a straight line, perpendicular to the axis of the container, at the seaming starting point using the seaming roll 14 shown in FIGS. 4*b*, 15*b* and 21. That is, FIG. 21 shows a method of manufacturing a seamed metal container according to this invention in which the extreme edges of the end closure and body flanges 1 and 2 are placed in the same relative positions as in the desired seam (FIG. 4*b*) at a given point during the seaming process when the extreme edge of the body flange 2 has reached a straight line 6' connecting the centers 3' and 4' of curvature at the exit and entry end of the forming groove of the seaming roll 14 which correspond to the common centers 3 and 4 of the groups of concentric circular arcs of the desired seam. The process point during the seaming process shown in FIG. 21 can be formed without the precurled portion on the end closure flange edge as shown in FIG. 20 by seaming the both flanges fitted temporarily after making the straight portion on the end closure flange edge portion instead of the precurled circular arc on said edge portion as shown in FIG. 20 using a seaming roll, instead of the one shown in FIG. 21, whose cross-sectional curve consists of, as shown in FIG. 29, a first circular arc centered on point 4' and having a center angle of 112.5 degrees and a radius of curvature that is equal to the sum of twice the thickness of the end closure flange, the thickness of the body flange and the radius of curvature on the inside of the circular arc at the extreme edge of the end closure flange at the center portion of the desired seam and an adjoining second circular arc being continuous in said first arc and centered on point 3'' and having a center angle of 67.5 degrees (defined by the straight lines 6' and 12'') and a radius of curvature that is equal to the sum of the thickness of the end closure flange and the radius of curvature on the inside of the circular arc at the edge of the end closure flange at the center portion of the desired seam. With the use of the seaming roll shown in FIG. 21, seaming is accomplished by following the same procedure as illustrated in FIG. 21. The seaming roll 14 shown in FIG. 29 is an example of such seam rolls as have a forming groove whose cross-section consists of a plurality of continuous circular arcs, each having a center angle of 0 degree to less than 180 degrees, the centers of the circular arcs are separated from each other by a distance equal to $\frac{1}{2}$ of the sum of the thicknesses of a plurality of metal sheets making up the seam. More particularly, the forming groove of the seaming roll 14 consists of a first circular arc having a center angle of 112.5 degrees, a second circular arc 0 degree, and a third circular arc 67.5 degrees. The seaming roll also has a forming groove whose crosssection consists of a first circular arc whose center angle exceeds 90 degrees, starting from the base line of the forming groove that is perpendicular to the direction in which the seaming roll operates, and one or more circular arcs that are continuous to said first arc and also to each other, with the sum of the center angles of the first and succeeding circular arcs being equal to or less than 180 degrees. The first circular arc of the seaming roll 14 shown in FIG. 29 has a center angle larger than 90 degrees or, more specifically, of 112.5 degrees, so a bending force and a force working in the seaming direction work on the extreme edge of the end closure flange when the formation of a circular arc having a small radius of curvature begins in the second circular arc. This facilitates forming the circular arc with a small radius of curvature at the extreme edge of the end closure flange 1, eliminating the necessity of precurling the end closure flange. When used for precurling, the seaming roll 14 shown in FIG. 29 must have such a first circular arc whose radius of curvature is smaller than the maximum radius of curvature on the contour of the desired seam. When the center angle of the first circular arc is not larger than 90 degrees, either only a bending force perpendicular to the axis of the container or the same bending force and a force working in a direction opposite to the seaming direction work at the extreme edge of the end closure flange, creating a strong likelihood of causing buckling or other failure in the following portion of the flange. In FIG. 21, the winding angle of the extreme edge of the body flange 2 from a straight line at the seaming starting point perpendicular to the axis of the container is larger than 90 degrees. More specifically, the winding angle is 112.5 degrees, or 180 degrees smaller than the angle of 292.5 degrees over which seaming is completed. FIG. 23 shows a process point during the seaming process at which the extreme edge of the body flange 2 has been wound over 202.5 degrees by depressing the seaming roll 13. In FIG. 22, the edge portion of the body flange 2 at the center portion of the seam is formed to have the same radius of curvature as at the edge portion of the body flange 2 at the center portion of the desired seam shown in FIG. 4*b*. FIG. 21 shows an example of a method of manufacturing a seamed metal container according to this invention in which the extreme edges of the end closure and body flanges 1 and 2 are put in such relative positions as should be occupied at the center portion of the desired seam when the process point is reached at which the extreme edge of the body flange begins to be formed to the same radius of curvature as that the edge portion of the body flange has at the center portion of the desired seam. Reference numerals 3', 4', 6', 8', 12' and 13' in FIGS. 21 and 22 relate to the seaming roll 14 and correspond to reference numerals 3, 4, 6, 8, 12 and 13 in FIG. 4*b*, respectively.

If the extreme edge of the body flange 2 is formed into the minimum radius of curvature at the center portion of the seam with a winding angle of 90 degrees, the entirety of the body flange 2 may be pushed downward in the direction of the container proper when the seaming roll 14 is depressed, thereby likely making it impossible to achieve the desired or seaming. If, on the other hand, the extreme edges of both flanges are put in the same relative positions as should be occupied at the center of the desired seam when the extreme edge of the body flange 2 has been wound over an angle of more than 90 degrees as shown in FIG. 21, the end closure flange 1 turns to the right in FIG. 21 when the seaming roll 14 is depressed about the center 4' between the entry end of the forming groove R and the point intersecting with the straight line 6' and about the center 3' between said point crossing the straight line 6' and the point intersecting with a one point chain line at the exit end of the forming groove R. The end closure flange 1 exerts a composite force, consisting of a bending force to the center 3' and a winding force, on the body flange 2 in contact to cause the body flange 2 to turn to the right. Then the circular arc at the edge portion of the end closure flange 1, which has the minimum radius of curvature at the center portion of the seam, cramps the extreme edge of the body flange 2, thereby precluding said likelihood of imperfect winding through the prevention of the descent deformation of the body flange 2.

It is possible to put the extreme edges of both flanges in the relative positions that should be occupied at the center of the seam in an earlier stage of the seaming operation, forming the center portion of the seam afterward. In this case, however, the extreme edge of the body flange 2 shown in FIG. 20 approaches the extreme edge of the end closure flange 1, as a result of which the straight portion of the body flange 2 decreases while the curved portion thereof increases to decrease the body sheet proper 2' and, therefore, the area of contact between the body sheet proper 2' and the end closure sheet proper 1'. The result is a strong likelihood of the end closure sheet falling away from the body sheet while the assembly is being transferred from the temporary fitting stage to the seaming stage. Especially when the extreme edges of both flanges are put in said relative positions at the beginning of winding, the body flange 2 will consist of only the curved portion and have no straight portion at all unlike the one shown in FIG. 20, thereby reducing the area of contact between the end closure and body sheets proper to a minimum. As a consequence, temporary fitting will become difficult and even the temporarily fitted end closure sheet may come off easily. When the seaming roll is depressed, the extreme edge of the body flange 2 will not be deformed properly but pushed down instead, with the radius of curvature of the temporarily fitted curved portion decreasing. But this likelihood is small with certain types of seams, like the one shown in FIG. 3 or in FIG. 8, because the forming with the minimum radius of curvature at the edge of body flange is formed at final stage of the seaming by a bending force working in a direction opposite to the direction of the depressing force of the seaming roll in the one shown in FIG. 3 and the length of the body flange is short in the one shown in FIG. 8.

The extreme edges of both flanges can be put in the relative positions to be occupied at the center portion of the desired seam when the extreme edge of the body flange 2 has been wound over an angle between from the winding angle to be attained on completion of seaming to an angle 180 degrees smaller than said ultimate winding angle. In this case, however, there is a likelihood that said forming to the minimum radius of curvature becomes impossible, with the extreme edge of the body flange 2 depressed until it comes in contact with the extreme edge of the end closure flange 1, because the circular arc at the extreme edge of the end closure flange remains uncramped. The manufacturing methods and apparatuses according to this invention reduce such a likelihood when the number of windings is small and the minimum radius of curvature is relatively large because the extreme edge of the body flange is formed along the inside of the end closure flange formed into a plurality of continuous circular arcs without striking thereagainst.

For a seam in which either or both of the center angles of the circular arcs having the minimum radius of curvature at the center portion of the seam is between 0 degree and 180 degrees, as illustrated in FIGS. 11 through 13, it is desirable to put the extreme edges of both flanges into the relative positions to be occupied at the center portion of the seam or to start bending the extreme edge of the body flange to a radius of curvature equal to the minimum radius of curvature of the seam when the extreme edge of the body flange has been wound over an angle that is between 0 degree and 180 degrees smaller, corresponding to said center angle between 0 degree and 180 degrees, than the ultimate winding angle.

FIG. 23 shows a method of manufacturing a seamed metal container according to this invention in which the edge portion of the end closure flange 1 is preformed into a circular arc having a radius of curvature and a center angle equal to those at the center portion of the desired seam and the edge portion of the body flange 2 is preformed into a circular arc having a radius of curvature equal to that of the edge portion of the body flange 2 at the center portion of the desired seam and a center angle of 90 degrees, and the both flanges thus formed are temporarily fitted together. The circular arc at the edge portion of the end closure flange may be formed also after the temporary fitting. The end closure flange 1 shown in FIG. 23 is the same as the one in FIG. 20. The length of the straight portion of the body flange 2 is 5.82 times and the radius of curvature at the center of thickness of the curved portion thereof is 3.33 times the thickness of the flange, respectively. When seaming is started from the temporarily fitted state shown in FIG. 23, with the use of the seaming roll 14, the extreme edges of both flanges 1 and 2 come into the relative positions to be occupied at the center portion of the desired seam when the extreme edges have been wound over an angle of 382.5 degrees and 202.5 degrees, respectively, from a straight line at the seaming starting point perpendicular to the axis of the container. This process point during the seaming point is the same as the one shown in FIG. 22. That is, FIG. 22 shows a transitional point where the extreme edges of both flanges 1 and 2 have been wound over an angle of 382.5 degrees and 202.5 degrees, with the use of the seaming roll 14, from the straight line perpendicular to the axis of the container. The forming operation up to the same transitional point is smooth and easy because the seaming roll 14 does not perform a forming with a radius of curvature equal to the minimum radius of curvature at the center portion of the desired seam (FIG. 4*b*) until said point is reached, the edge portion of the body flange 2 having a preformed circular arc with a center angle of 90 degrees. The center portion of the seam has been already formed. The forming with the minimum radius of curvature at the center portion of the seam begins when the seaming roll 14 is then depressed. Compared with the cases of FIGS. 21 and 22 following the state shown in FIG. 20, the likelihood of the forming with the minimum radius of curvature becoming impossible is smaller since the portion of body flange formed by the seaming roll is restrained more strongly from being depressed toward the container. The extreme edge of the body flange 2 is completely cramped by the circular arc formed with the minimum radius of curvature at the extreme edge of the end closure flange 1. As a consequence, a circular arc having a center angle of 180 degrees, which is equal to the one at the center portion of the desired seam, is smoothly formed at the edge portion of the body flange 2, without depressing the entirety of the body flange 2 in the direction of the container.

In FIG. 22, the winding angle of 202.5 degrees, over which the extreme edge of the body flange 2 has been wound from the temporarily fitted state in FIG. 23, is equal to the ultimate winding angle minus 90 degrees.

Instead of the circular arc having the center angle of 90 degrees as shown in FIG. 23, a circular arc having a center angle smaller than 90 degrees and a radius of curvature equal to the minimum radius of curvature at the edge portion of the body flange 2 at the center portion of the desired seam may be preformed at the edge portion of the body flange 2. By then starting seaming from the temporarily fitted state analogous to that shown in FIG. 23, it becomes possible to put the extreme edges of both flanges 1 and 2 into the relative positions to be occupied at the center portion of the desired seam at a transitional point where the extreme edge of the body flange 2 has been wound over an angle equal to a larger angle of inclination (an external angle, or 112.5 degrees in FIG. 22) which the straight line 6' in FIG. 22 forms with the axis of the container. Like the case in which a circular arc having a center angle of 90 degrees is pre-formed at the edge portion of the body flange 2, this forming with the minimum radius of curvature also can be accomplished smoothly, although the amount of forming involved is greater. In the case of FIG. 23 in which the desired seam shown in FIG. 4*b* is formed by pre-forming a circular arc having a center angle of not larger than 90 degrees at the edge portion of the body flange 2 and starting seaming from an appropriate temporarily fitted condition depending on the pre-formed circular arc, the ultimate angle over which the extreme edge of the body flange 2 is wound is 292.5 degrees from a straight line at the seaming starting point perpendicular to the axis of the container. At a transitional point in FIG. 22 which varies with the center angle of not larger than 90 degrees, or ranging between 0 degree and 90 degrees, of the circular arc pre-formed at the edge portion of the body flange, the extreme edge of the body flange 2 is wound over an angle that is equal to said ultimate winding angle minus an angle between 90 degrees and 180 degrees according to said center angle of between 90 degrees and 0 degree.

Figure 17:
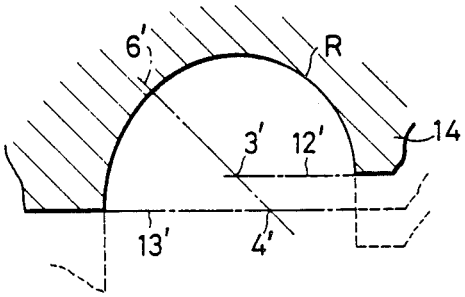
Figure 18:
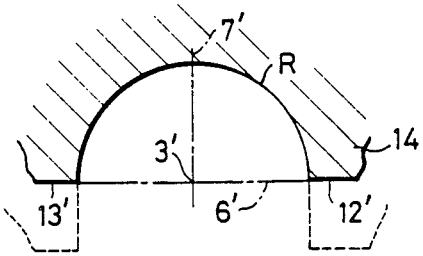
Figure 19:
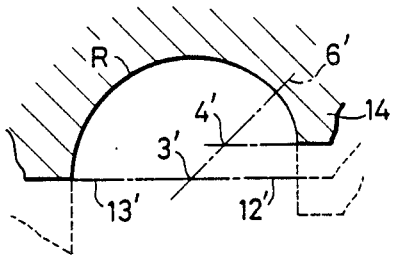

For the seam and seaming roll shown in FIGS. 6 and 17, it is possible to put the extreme edges of both flanges 1 and 2 in the relative positions to be occupied at the center portion of the seam when the extreme edge of the body flange 2 has reached a transitional point that is more than 90 degrees away from a straight line at the seaming starting point perpendicular to the axis of the container by pre-forming a circular arc having a center angle that is larger than the angle formed between the straight lines 6 and 7. In the subsequent forming operation, the circular arc at the edge portion of the end closure flange 1 keeps the extreme edge of the body flange 2 from being depressed.

The desired seam shown in FIG. 4*b* can be formed smoothly and exactly by starting seaming from the temporarily fitted state shown in FIG. 20 or 23, forming the center portion of the desired seam, shown in FIG. 4*b*, at the transitional point shown in FIG. 21 or 22, depressing the seaming roll, and winding said center portion on the inside of the following body flange 2 or winding the following flanges 1 and 2 around said center portion.

The method of forming a desired seam by starting seaming from the temporarily fitted state shown in FIG. 23, forming the center portion of the desired seam at the transitional point shown in FIG. 22, and winding said center portion on the inside of the following body flange 2 is an example of a method of manufacturing a seamed metal container according to this invention which comprises forming, at the edge portion of the body flange 2, a hook bent over an angle of not larger than 90 degrees, or a circular arc having a center angle of not larger than 90 degrees, or a circular arc having a radius of curvature equal to the minimum radius of curvature of the body flange at the center portion of the desired seam, or a circular arc having said radius and a center angle of not larger than 90 degrees, starting seaming after temporarily fitting together both flanges appropriately, seaming together both flanges 1 and 2 with the use of the seaming roll 14 which has a forming groove adapted to form, in the course of seaming, the edge portion of the body flange into the radius of curvature desired to exist at the center portion of the desired seam, placing the extreme edges of both flanges 1 and 2 into such relative positions as should be occupied in the completed seam when the extreme edge of the body flange 2 has been wound over an angle of over 90 degrees from a straight line at the seaming starting point perpendicular to the axis of the container to an angle that is smaller than the ultimate winding angle by between less than 180 degrees and 90 degrees, or placing the extreme edges of both flanges in such relative positions ahd, further, forming that portion of the body flange 2 which is next to the pre-formed circular arc at the edge portion of the body flange 2 and forms the center portion of the seam into a curve that has a radius of curvature equal to the radius of curvature at the center of the desired seam.

The seam shown in FIG. 11 can be made the same methods by which the seam shown in FIG. 4*b* is made as shown in FIGS. 20 through 23, except that the center angle of the circular arc at the edge portion of the end closure flange 1 is reduced from 180 degrees to 157.5 degrees and the length of the straight portion of the body flange 2 is decreased by the length of the line that extends through the center of the thickness of the circular arc whose radius of curvature at the center of the thickness is equal to the thickness thereof and whose center angle is 22.5 degrees. The seams shown in FIGS. 12 and 13 can be made by a method analogous to that which is applied to the seam shown in FIG. 11.

The seam shown in FIG. 12 can be made by pre-forming, at the edge portion of the body flange 2 shown in FIG. 23, a circular arc having a center angle of 90 degrees and a radius of curvature equal to the minimum radius of curvature of the body flange in the desired seam, starting seaming after temporarily fitting both flanges 1 and 2 together in an appropriate manner, forming the center portion of the desired seam by placing the extreme edges of both flanges in such relative positions as should be occupied at the center portion of the desired seam when the extreme edge of the end closure flange 1 has been wound over 180 degrees from the seaming starting point, and completing seaming.

The seams shown in FIGS. 3, 9 and 10 can be made by forming, as the first step, the center of a desired seam by placing the extreme edges of both flanges 1 and 2 in such relative positions as should be occupied at the center portion of the desired seam at the transitional point described by reference to FIGS. 21 and 22, with the use of a seaming roll 14 similar to the one shown in FIG. 15*b*, by the methods described by reference to FIGS. 20 and 21 or FIGS. 22 and 23, and then, as the second step, stopping or moving back, toward the seaming starting point, the seaming roll 14 at said transitional point and, at the same time, continuing seaming with the use of another seaming roll whose forming groove has a semicircular cross section and a radius of curvature equal to that of the contour of the desired seam (i.e., the contour of a sector having a center angle of 180 degrees and lying on that side of the seam which is opposite to the container), winding both flanges 1 and 2 around the center portion of the seam formed in the first step or winding the same center portion on the inside of the body flange 2, and further seaming both flanges tightly.

The methods of manufacturing a seamed metal container described by reference to FIGS. 20 through 23 are by no means limited by the kind, shape and structure of the seam, the radii of curvature, thicknesses and the difference between the thicknesses of both flanges 1 and 2 making up the seam, and the radius of curvature and curve of the forming groove of the seaming roll 14 which can be chosen as desired.

Figure 24:
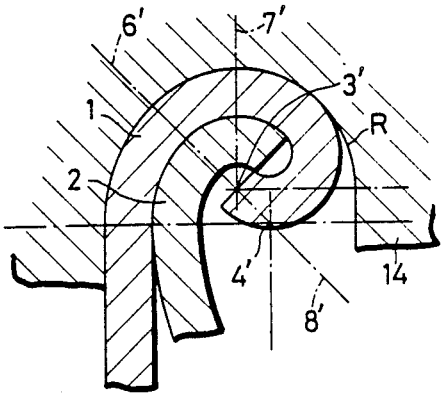
FIGS. 24 through 27 show the seaming processes of different fashions.
Figure 25:
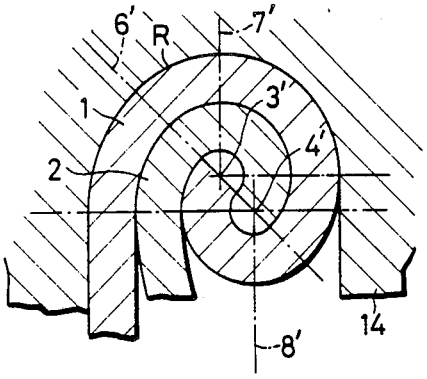

FIGS. 24 and 25 show another method of manufacturing a seamed metal container according to this invention. Namely, FIGS. 24 and 25 show transitional points analogous to those in FIGS. 22 and 23, at which the extreme edges of both flanges 1 and 2 are placed in such relative positions as should be occupied at the center portion of a desired seam, with the use of the seaming roll shown in FIG. 6 or 17, when the extreme edge of the body flange 2 has been wound over 135 degrees from a straight line at the seaming starting point perpendicular to the axis of the container. Forming up to the transitional point shown in FIG. 24 is easy because a circular arc having a center angle of 90 degrees and a radius of curvature equal to the minimum radius of curvature at the center portion of the desired seam can be pre-formed at the edge portion of the body flange 2. In the following seaming process, as described by reference to FIGS. 20 through 23, the extreme edge of the body flange 2 is cramped by the circular arc of 180 degrees at the edge portion of the end closure flange 1. The seam shown in FIG. 6 or the transitional point shown in FIG. 25 is obtained by further winding over 45 degrees. In FIGS. 24 and 25, the seam shown in FIG. 6 is formed, as the core of the desired seam, at the edge portions of both flanges 1 and 2, as the first step of forming a seam that has a larger number of windings than the one shown in FIG. 6. Then, any of the seams shown in FIGS. 3 through 5 can be formed by seaming, as the second step, additional layers over the core formed in the first step using the seaming rolls shown in FIGS. 3 through 5 and 14 through 16. Also, the seams shown in FIGS. 3 through 5 can be formed with the use of the seaming roll shown in FIG. 14, the seams shown in FIGS. 4*a* through 5 with the seaming roll shown in FIG. 15*a*, and the seams shown in FIGS. 4*b* and 5 with the seaming roll shown in FIG. 15*b*. All these seams can be formed by first forming the core of the desired seam as the first step, and then winding, as the second step, more flanges about the core formed in the first step. The use of two rolls permits forming various seams without requiring roll changing.

Figure 26:
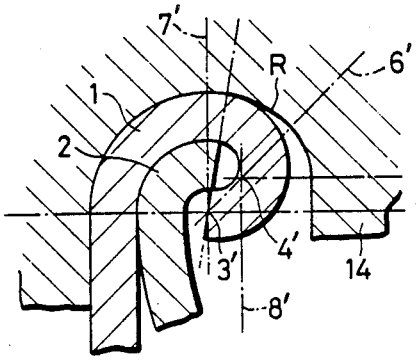
Figure 27:
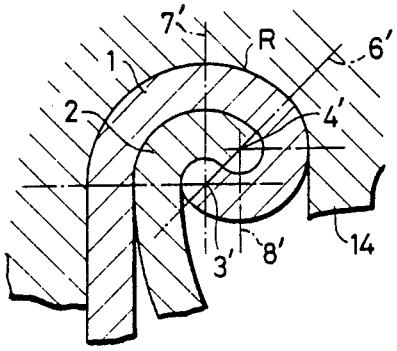

FIG. 26 shows still another method of manufacturing a seamed metal container according to this invention. Namely, FIG. 26 shows a transitional point analogous to those shown in FIGS. 22 through 25, at which the extreme edges of both flanges 1 and 2 are placed in such relative positions as should be occupied at the center portion of the desired seam, with the use of the seaming roll shown in FIG. 8 or 19, when the extreme edge of the body flange 2 has been wound over 110 degrees from a straight line at the seaming starting point perpendicular to the axis of the container. Forming up to the transitional point shown in FIG. 26 is quite easy because circular arcs each having a center angle of 100 degrees and 130 degrees can be pre-formed at the edge portion of the body and end closure flanges 2 and 1, respectively. In the following seaming process, the extreme edge of the body flange 2 is crampled by the circular arc at the edge portion of the end closure flange 1, as described by reference to FIGS. 20 through 25. By further winding over 35 degrees from the state shown in FIG. 26, the seam shown in FIG. 8 or the transitional point shown in FIG. 26 at which the seam of FIG. 8 is formed at the edge portions of both flanges as the core of the desired seam can be obtained. With said center angle of 130 degrees, the circular arc at the edge portion of the end closure flange is kept from striking against the outside of the circular arc at the edge portion of the body flange. The circular arc at the edge portion of the end closure flange may also have a somewhat larger central angle than 130 degrees. By tightly winding subsequent flanges around the core of the desired seam formed at the edge portions of both flanges as shown in FIG. 26 or 27, using the seaming rolls shown in FIGS. 3 through 7 or 14 through 18, the seams corresponding to the individual seaming rolls and those which have smaller number of windings can be formed.

Figure 14:
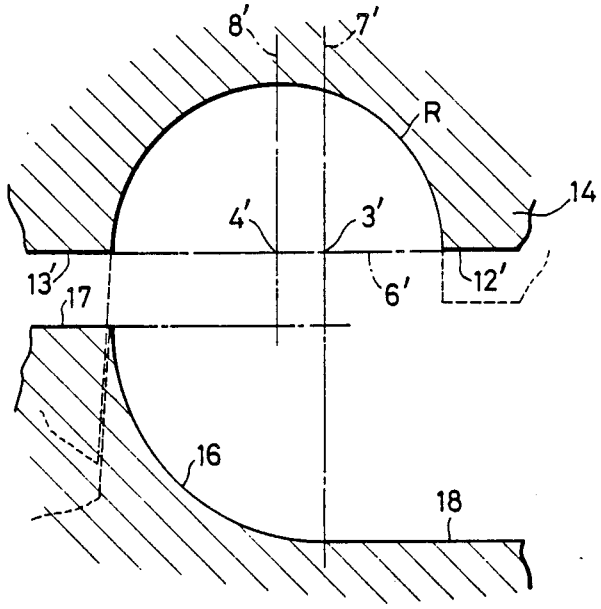
FIG. 14 is a cross-sectional view showing a seaming roll and chuck ring according to this invention for use in making the seam shown in FIG. 3.
Figure 28:
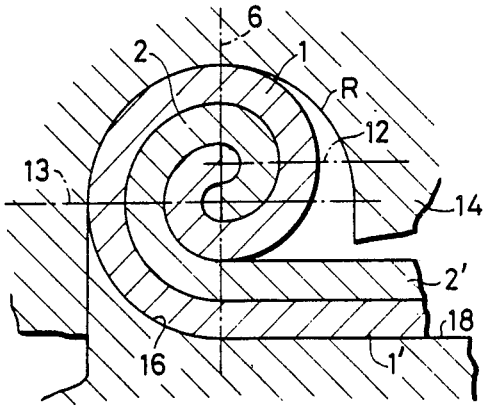
FIG. 28 shows how the seam shown in FIG. 5 is completed following the seaming processes shown in FIGS. 24 to 26.

FIG. 28 shows a method of manufacturing a seamed metal container according to this invention, in which the seam shown in FIG. 5 is formed from the transitional points showing FIGS. 24 through 26, with the use of the seaming roll shown in FIG. 14.

The circular arc at the edge portion of the body flange shown in FIG. 26 may have a central angle of over 90 degrees and smaller than 180 degrees. The circular arc at the edge portion of the end closure flange may have such a central angle of larger than 0 degree and smaller than 180 degrees, depending upon said center angle of over 90 degrees and smaller than 180 degrees, with which the circular arc at the edge portion of the end closure flange can be kept from striking against the outside of the circular arc at the edge portion of the body flange during seaming. With the methods described by reference to FIGS. 22 through 25 also, it is possible to preform a circular arc having a center angle of over 0 degree and smaller than 180 degrees at the edge portion of the body flange and a circular arc having a center angle appropriately chosen from a range of over 0 degree and smaller than 180 degrees, so as not to strike against the outside of the circular arc at the edge portion of the body flange, at the edge portion of the end closure flange.

The seams shown in FIG. 3, 5 and 6 can be formed in substantially the same manner as in forming a seam shown in FIG. 4*a* or 4*b*, FIGS. 4*a* or 4*b* and 6, and FIGS. 6 and 8, respectively, at the edge portions of both flanges by inclining the straight line 6 in the individual seams, the inclination angle of which is limited between 0 degree and 180 degrees, by a small angle larger than 0 degree.

According to the methods of manufacturing a seamed metal container of this invention, sealing compound may be injected at an appropriate time before seaming is started or in the earlier stage of the seaming operation.

The transitional point shown in FIG. 26 can be obtained without precurling the end closure flange 1 with the use of a seaming roll 14 shown in FIG. 30 in place of the one shown in FIG. 26, with the subsequent seaming operation being similar to those described by reference to FIGS. 26 and 27.

Figure 30:
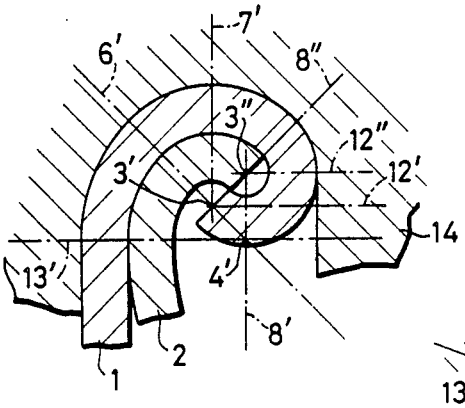

The seaming roll shown in FIG. 30 has a forming groove which consists of three continuous circular arcs. A first circular arc is centered on point 4' and has a center angle of 45 degrees measured from the base line 13' of the forming groove perpendicular to the direction in which the seaming roll operates, a second circular arc is centered on point 3' and has a center angle of 90 degrees, and a third circular arc is centered on point 3'' and has a center angle of 45 degrees, with the individual centers separated from each other by a distance equal to $\frac{1}{2}$ of the sum of the thicknesses of a plurality of metal sheets making up the seam. With the sum of the center angles of said continuous first and second circular arcs, measured from the base line 13', exceeding 90 degrees, said seaming roll forms a circular arc at the edge portion of end closure flange 1 with a winding angle of over 90 degrees from said base line 13'. The sum of the center angles of the first, second and third circular arcs is equal to 180 degrees. According to this invention, seaming rolls having such forming grooves as are analogous in cross section to those shown in FIGS. 29 and 30 can be obtained by combining various shapes of circular arcs. In FIG. 30, reference numeral 3'' designates the center of the third circular arc, 8'' a straight line passing through the centers 3' and 3'' of the second and third circular arcs, and 12'' a straight line that is perpendicular to the direction in which the seaming roll 14 operates or parallel to the axis of the container. Other reference numerals designate the same items as in FIG. 26.

Figure 31:
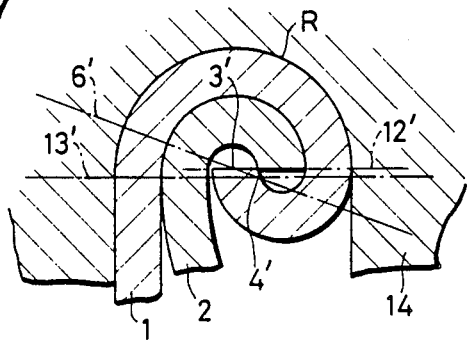
FIG. 31 is a cross-sectional view showing another seaming roll used in an apparatus for manufacturing a seamed metal container according to this invention.

FIG. 31 is a cross-sectional view exemplifying a seaming roll 14 according to this invention. The seaming roll 14 has a forming groove R which consists of a first circular arc centered on point 4' and having a center angle of 20 degrees and a radius of curvature equal to the sum of twice the radius of curvature of the circular arc at the edge portion of the body flange of the desired seam and the thicknesses of the end closure and body flanges and a second circular arc centered on point 3', which is separated from the center 4' of said first circular arc by a distance equal to $\frac{1}{4}$ of the sum of the thicknesses of the end closure and body flanges, having a center angle of 160 degrees and a radius of curvature equal to the sum of the radius of curvature of the circular arc at the edge portion of the body flange of the desired seam and the thicknesses of the end closure and body flanges, and adjoining continuous said first circular arc. The seaming roll 14 can be used as a first seaming roll to form the center portion of a desired seam during seaming according to the methods of manufacturing a seamed metal container of this invention described by reference to FIGS. 20 through 30. Following this first step, various types of desired seams with a larger number of windings can be formed with the use of an appropriate second seaming roll analogous to those described in said methods. FIG. 31 exemplifies a seaming roll that is used as the first seaming roll in the methods and apparatuses of manufacturing seamed metal containers according to this invention described. The seaming roll of FIG. 31 has a forming groove whose cross section consists of a plurality of continuous circular arcs, at least one of the continuous circular arcs having a radius of curvature equal to the sum of the minimum radius of curvature on the inside of the body flange in the desired seam and the thicknesses of the body flange and end closure flange. Likewise, the seaming rolls shown in FIGS. 4*a* through 8, 11 through 13, 15*a* through 19, 21, 22, 24 through 27, 29 and 30 can be used in the methods of manufacturing a seamed metal container according to this invention.

When it is unlikely that the body flange 2 is depressed or undergoes buckling or other undesirable deformation, the methods of manufacturing a seamed metal container according to this invention can be implemented without pre-forming a circular arc at the edge portion of the body flange. Precurling the edge portion of the body flange, however, permits forming the center portion of the desired seam with great ease and exactness.

According to the methods of manufacturing a seamed metal container according to this invention, it is also possible to provide a roll to hold the body flange between the seaming roll and chuck ring in order to prevent the occurrence of said undesirable deformation during seaming. The support roll of this type prevents the occurrence of undesirable deformation by supporting an appropriate point in the straight or curved portion of the body flange from the right-hand side in a direction that is parallel to the axis of the container, or perpendicular to the direction in which the seaming roll operates, or aslant to said two directions in, for example, FIGS. 20 through 27 and 29 through 31. The support roll may be designed to release the body flange and move to a non-interfering position at an appropriate advanced point in the seaming process.

What is claimed is:

1. A metal container comprising: a body and an end closure closing at least one end of the body; and a seam at said one end of said body formed from seaming flanges extending outward in a radial plane from an edge portion of said body and from an edge portion of said end closure, said seam comprising, when viewed in cross section, two groups of concentric circular arc portions each having two ends and concentric around two centers of curvature and constituted by the seamed flanges, said centers of curvature lying on a common center line extending across said seam and spaced from each other therealong a distance equal to one-half of the sum of the thickness of said body flange and said end closure flange, said flanges being contiguous to each other throughout the seam, said two groups of arc portions meeting on said common center line, both ends of the circular arc portions of one group of said two groups and both ends of at least one circular arc portion of the other group coinciding with said common center line, each end of each circular arc portion of one group of said two groups on each said flange, other than the extreme ends of said flanges and the ends where the respective portions join the body and the end closure, being joined continuously, at said common center line, to the corresponding next different size circular arc portion of the other group on the same flange along a common tangent and with a difference between the radius of curvature of each said arc portion of one group and the radius of curvature of each said arc portion of the other group of one-half of the sum of the thicknesses of said body flange and said end closure flange, said circular arc portions of one group having a center angle of 180 degrees and said circular arc portions of the other group having at least one circular arc portion with a center angle of 180 degrees and two circular arc portions constituted by the parts of the respective flanges on the outside of said seam and having a center angle of up to 180 degrees from said common center line to the points where the respective flanges join said body and said end closure, the extreme end edges of the flanges at the center of the seam and the inner surfaces of the portion of the flanges adjacent said extreme end edges defining a space at the center of the seam, and a sealing compound filling said space.

2. A metal container according to claim 1, wherein said common center line is at an angle of inclination ranging from zero to 180 degrees relative to the longitudinal axis of said body extending through said end closure.

3. A metal container according to claim 1, wherein said common center line is perpendicular to the longitudinal axis of said body extending through said end closure, each group of said two groups being composed of semicircular arc portions and meeting on said common center line.

4. A metal container comprising: a body and an end closure closing at least one end of the body; and a seam at said one end of said body formed from seaming flanges extending outward in a radial plane from an edge portion of said body and from an edge portion of said end closure, said seam comprising, when viewed in cross section, two groups of concentric circular arc portions concentric around two centers of curvature and constituted by the seamed flanges, said centers of curvature lying on a common center line extending across said seam and spaced from each other therealong a distance equal to one-half of the sum of the thicknesses of said body flange and said end closure flange, said flanges being contiguous to each other throughout the seam, said two groups of arc portions meeting on said common center line, said two groups being constituted by four sectors composed of two sectors of one group of said two groups and two sectors of the other group, said two sectors of one group being defined by said common center line and a straight line passing through the center of curvature of said one group perpendicular to the longitudinal axis of the body extending through the end closure, said two sectors of the other group being defined by said common center line and a straight line passing through the center of curvature of said the other group perpendicular to said longitudinal axis of the body, each sector comprising a plurality of concentric circular arc portions each having two ends, two adjacent sectors having circular arc portions concentric about the one center of said two centers, the other two adjacent sectors having circular arc portions concentric about the other of said two centers, the end of the corresponding circular arc portions of adjacent sectors being joined continuously, the ends of the circular arc portions about adjacent different centers and said sectors meeting on said common center line and being joined continuously at said common center line to the corresponding next different size circular arc portions in the other group, the extreme end edges of the flanges at the center of the seam and the inner surfaces of the portions of the flanges adjacent said extreme end edges defining a space at the center of the seam, and a sealing compound filling said space.

5. A metal container comprising: a body and an end closure closing at least one end of the body; and a seam at said one end of said body formed from seaming flanges extending outward in a radial plane from an edge portion of said body and from an edge portion of said end closure, said seam comprising, when viewed in cross section, two groups of concentric circular arc portions concentric around two centers of curvature and constituted by the seamed flanges, said centers of curvature lying on a common center line extending across said seam and spaced from each other therealong a distance equal to one-half of the sum of the thicknesses of said body flange and said end closure flange, said flanges being contiguous to each other throughout the seam, said two groups of arc portions meeting on said common center line, said two groups being constituted by four sectors composed of two sectors of one group of said two groups and two sectors of the other group, said two sectors of one group being defined by said common center line and a straight line passing through the center of curvature of said one group perpendicular to the common center line, said two sectors of the other group being defined by said common center line and a straight line passing through the center of curvature of said the other group perpendicular to said common center line, each sector comprising a plurality of concentric circular arc portions each having two ends, two adjacent sectors having circular arc portions concentric about the one center of said two centers, the other two adjacent sectors having circular arc portions concentric about the other of said two centers, the end of the corresponding circular arc portions of adjacent sectors being joined continuously, the ends of the circular arc portions about adjacent different centers and said sectors meeting on said common center line and being joined continuously at said common center line to the corresponding next different size circular arc portions in the other group, the extreme end edges of the flanges at the center of the seam and the inner surfaces of the portions of the flanges adjacent said extreme end edges defining a space at the center of the seam, and a sealing compound filling said space.

6. A metal container according to any of claims 1, 2, 3, 4 or 5, wherein said two groups of concentric circular arc portions are in a shape of point symmetry having a center of symmetry which is midway between said two centers of curvature.

7. A metal container according to any of claims 1, 2, 3, 4 or 5, wherein at least one of the two circular arc portions on the extreme end of the body flange and the end closure flange has a center angle of smaller than 180 degrees.

* * * * *